US010475426B2

(12) United States Patent
Summers

(10) Patent No.: US 10,475,426 B2
(45) Date of Patent: Nov. 12, 2019

(54) CHARACTERIZING AUDIO USING TRANSCHROMAGRAMS

(71) Applicant: Gracenote, Inc., Emeryville, CA (US)

(72) Inventor: Cameron Aubrey Summers, Oakland, CA (US)

(73) Assignee: Gracenote, Inc., Emeryville, CA (US)

( * ) Notice: Subject to any disclaimer, the term of this patent is extended or adjusted under 35 U.S.C. 154(b) by 0 days.

(21) Appl. No.: 16/203,811

(22) Filed: Nov. 29, 2018

(65) Prior Publication Data

US 2019/0096371 A1 Mar. 28, 2019

Related U.S. Application Data

(63) Continuation of application No. 15/689,900, filed on Aug. 29, 2017, now Pat. No. 10,147,407.

(60) Provisional application No. 62/381,801, filed on Aug. 31, 2016.

(51) Int. Cl.

| | |
|---|---|
| ***A63H 5/00*** | (2006.01) |
| ***G04B 13/00*** | (2006.01) |
| ***G10H 1/00*** | (2006.01) |

(52) U.S. Cl.

CPC ..... *G10H 1/0008* (2013.01); *G10H 2210/066* (2013.01); *G10H 2210/081* (2013.01); *G10H 2240/075* (2013.01); *G10H 2240/141* (2013.01); *G10H 2250/015* (2013.01); *G10H 2250/215* (2013.01)

(58) Field of Classification Search

CPC ..... G10H 1/0008; G10H 2210/066; G10H 2210/081; G10H 2240/075; G10H 2250/215; G10H 2250/015

USPC ..... 84/609

See application file for complete search history.

(56) References Cited

U.S. PATENT DOCUMENTS

| | | | |
|---|---|---|---|
| 7,910,819 | B2 | 3/2011 | Van De Par et al. |
| 8,069,036 | B2 | 11/2011 | Pauws et al. |
| 8,158,870 | B2 | 4/2012 | Lyon et al. |
| 9,055,376 | B1 | 6/2015 | Postelnicu et al. |
| 9,183,849 | B2 | 11/2015 | Neuhauser et al. |
| 9,195,649 | B2 | 11/2015 | Neuhauser et al. |
| 9,257,111 | B2 | 2/2016 | Sumi |

(Continued)

OTHER PUBLICATIONS

United States Patent and Trademark Office, "Notice of Allowance," issued in connection with U.S. Appl. No. 15/689,900, filed Aug. 1, 2018, 7 pages.

(Continued)

*Primary Examiner* — Jeffrey Donels

(74) *Attorney, Agent, or Firm* — Hanley, Flight & Zimmerman, LLC

(57) ABSTRACT

Methods, systems and apparatus to characterize audio using transchromagrams are disclosed. An example apparatus includes a transchromagram generator to generate a data structure based on a set of transition matrices corresponding to a plurality of time frames of audio data, the data structure indicative of probabilities that first musical notes will transition to second musical notes, a database controller to prompt a database to store the data structure within the audio data, and a notification manager to generate, based on a comparison between query audio data and the stored data structure of the audio data, a notification identifying at least one characteristic of the query audio data.

20 Claims, 10 Drawing Sheets

(56) References Cited

U.S. PATENT DOCUMENTS

| | | | | |
|---|---|---|---|---|
| 10,147,407 | B2 | 12/2018 | Summers | |
| 2010/0198760 | A1 | 8/2010 | Maddage et al. | |
| 2011/0314995 | A1* | 12/2011 | Lyon | G10H 1/0008 84/609 |
| 2013/0297297 | A1* | 11/2013 | Guven | G10L 15/02 704/204 |
| 2014/0330556 | A1* | 11/2014 | Resch | G10H 1/0008 704/221 |
| 2015/0302086 | A1 | 10/2015 | Roberts et al. | |
| 2016/0196343 | A1* | 7/2016 | Rafii | G10L 25/54 707/730 |
| 2017/0024615 | A1* | 1/2017 | Allen | G06K 9/00711 |
| 2018/0139268 | A1* | 5/2018 | Fuzell-Casey | H04L 67/20 |

OTHER PUBLICATIONS

United States Patent and Trademark Office, "Non-final Office Action," issued in connection with U.S. Appl. No. 15/689,900, filed Dec. 29, 2017, 6 pages.

* cited by examiner

CHARACTERIZING AUDIO USING TRANSCHROMAGRAMS

RELATED APPLICATION

This patent arises from a continuation of U.S. patent application Ser. No. 15/689,900, filed on Aug. 29, 2017, now U.S. Pat. No. 10,147,407, entitled "Characterizing Audio Using Transchromagrams," which claims priority to U.S. Provisional Patent Application No. 62/381,801, entitled "Characterizing Audio Using a Data Structure," filed on Aug. 31, 2016. U.S. patent application Ser. No. 15/689,900 is hereby incorporated herein by reference in its entirety. Priority to U.S. Provisional Patent Application No. 62/381,801 is claimed.

FIELD OF THE DISCLOSURE

The subject matter disclosed herein generally relates to the technical field of special-purpose machines that perform audio processing, including computerized variants of such special-purpose machines and improvements to such variants, and to the technologies by which such special-purpose machines become improved compared to other special-purpose machines that perform audio processing. Specifically, the present disclosure addresses systems and methods to facilitate characterizing audio using transchromagrams.

BACKGROUND

Tonality, the harmonic and melodic structure of musical notes, is a core element of music. Chromagrams, which can be represented using data structures, can be used as audio signal processing inputs in the computational extraction of frequency information, such as tonality information. A chromagram can be generated (e.g., calculated) by performing, for example, a Constant Q Transform (CQT), a Fourier Transform, etc. of a time window (e.g., a time frame) of an audio signal and then mapping the energies of the transform into various ranges of frequencies (e.g., a high band, a middle band, a low band, etc.).

BRIEF DESCRIPTION OF THE DRAWINGS

Some examples are illustrated by way of example and not limitation in the figures of the accompanying drawings.

Figure 1:
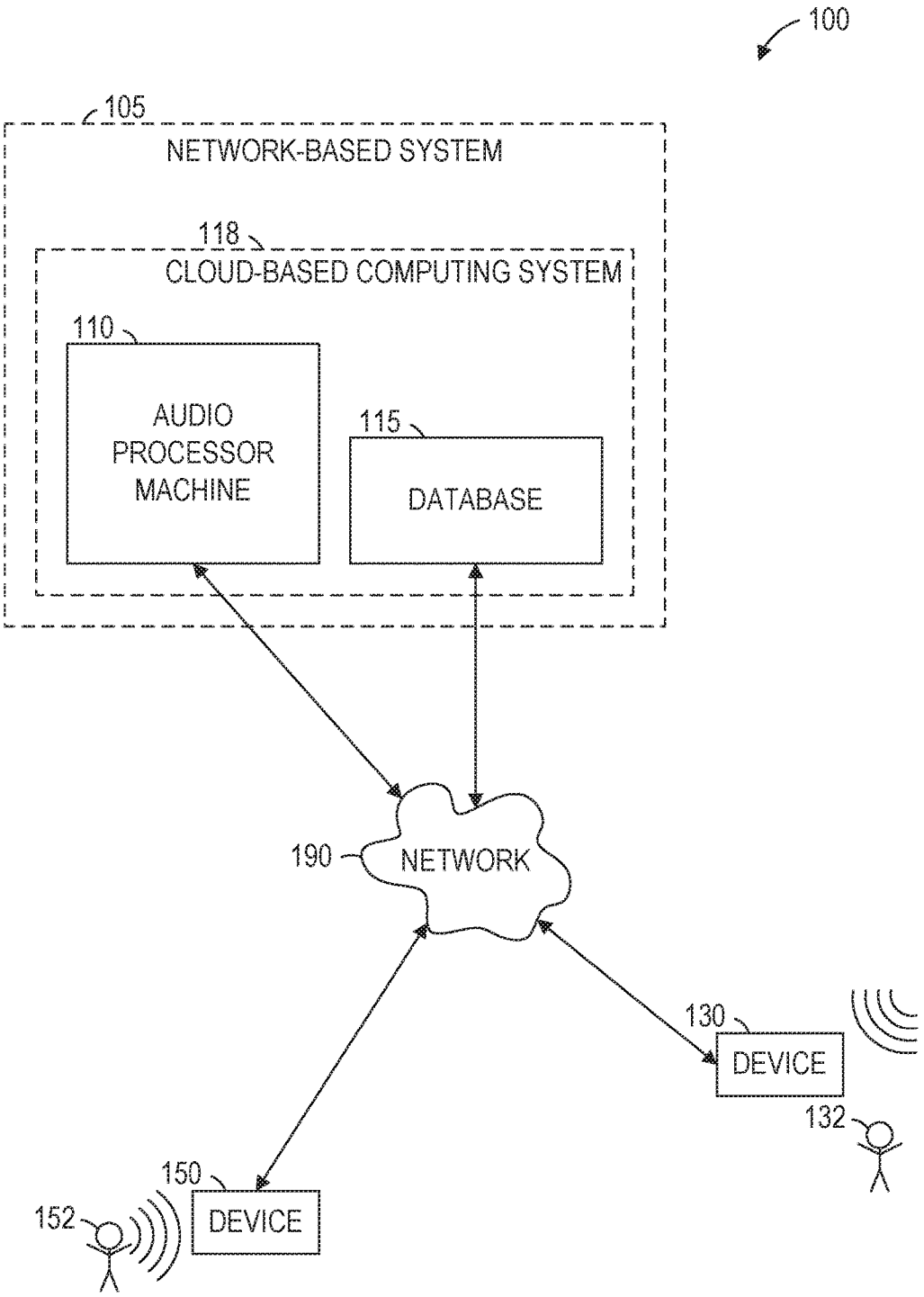
FIG. 1 is a network diagram illustrating an example network environment suitable for operating an example audio processor machine configured to characterize audio using a transchromagram, among other tasks, according to some disclosed examples.

The figures are not to scale. Wherever possible, the same reference numbers will be used throughout the drawing(s) and accompanying written description to refer to the same or like parts. Connecting lines or connectors shown in the various figures presented are intended to represent example functional relationships and/or physical or logical couplings between the various elements.

DETAILED DESCRIPTION

Tonality, the harmonic and melodic structure of musical notes, is a core element of music, but the problem of using computational methods to reliably extract this information from audio remains unsolved. There has been some limited work done in configuring a machine (e.g., a musical information retrieval machine) to perform identification of the musical chords of a song or the musical key of the song, but existing efforts do not provide broad usefulness across the full musical landscape. Accordingly, a musician trying to play along with a randomly chosen song using harmony information (e.g., musical key or chords) obtained using the current computational extraction methods, will likely experience frustration at the accuracy of the harmony information.

Music may be characterized by mapping energy of the music in a time window into various ranges of frequencies (e.g., a high band, a middle band, and a low band). Similar mappings may be performed for multiple time windows (e.g., a series of time frames) within a song. These mappings can be combined (e.g., grouped) together to represent (e.g., model or otherwise indicate) the energies in the frequency ranges over time within the audio signal. Various preprocessing operations, post-processing operations, or both, can be applied to the combined mappings to remove non-tonal energies and align the represented energies into their respective frequency ranges. From this point, example computational extractions of frequency information can apply some metric to quantify similarity between time frames of different chromagrams.

Disclosed example machines (e.g., an audio processor machine) may be configured to interact with one or more users to provide information regarding an audio signal or audio content thereof (e.g., in response to a user-submitted request for such information). In some examples, such information may identify the audio content, characterize (e.g., describe) the audio content, identify similar audio content (e.g., as suggestions or recommendations), or any suitable combination thereof. For example, the machine may perform audio fingerprinting to identify audio content (e.g., by comparing a query fingerprint of an excerpt of the audio content against one or more reference fingerprints stored in a database). The machine may perform such operations as part of providing an audio matching service to one or more client devices. In some examples, the machine may interact with one or more users by identifying or describing audio content and providing notifications of the results of such identifications and descriptions to one or more users (e.g., in response to one or more requests). Such a machine may be implemented in a server system (e.g., a network-based cloud of one or more server machines), a client device (e.g., a portable device, an automobile-mounted device, an automobile-embedded device, or other mobile device), or any suitable combination thereof.

Some disclosed example methods (e.g., algorithms) facilitate characterization of audio using a transchromagram and related tasks, and example systems (e.g., special-purpose machines) are configured to facilitate such characterization and related tasks. Broadly speaking, a transchromagram represents the likelihood(s) that a particular note in a piece of music will be followed by another particular note. For example, when an A note is being played it is most likely that a D note and then an E note will follow. Thus, a transchromagram represents the dynamic nature (e.g., how a piece of music changes, evolves, etc. over time) of a piece of music. Because different pieces of music have different progressions of notes (e.g., different melody lines, etc.), they will have different transchrotnagrams, and, thus, transchromagrams can be used to distinguish one piece of music from another. Examples merely typify possible variations. Unless explicitly stated otherwise, structures (e.g., structural components, such as modules) are optional and may be combined and/or subdivided, and operations (e.g., in a procedure, algorithm, or other function) may vary in sequence, be combined, and/or subdivided. In the following description, for purposes of explanation, numerous specific details are set forth to provide a thorough understanding of various examples. It will be evident to one skilled in the art, however, that the present subject matter may be practiced without these specific details.

In a chromagram, each time frame represents, models, encodes, or otherwise indicates energies at various frequencies (e.g., in various frequency ranges that each represent a different musical note) in one time period of the audio content (e.g., within one time frame of a song). However, a chromagram contains no representation of how frequencies (e.g., frequency bins that represent musical notes) change within that period of time. Although it is possible to calculate how notes change from one time frame to another within the chromagram, calculating a similarity metric between two sequential time frames would involve only sequential instantaneous harmonies (e.g., sequential instantaneous combinations of musical notes). Thus, although some tonal information is captured by a chromagram, analyzing chromagrams may ignore tonalities defined by sequential notes (e.g., sequences of notes or sequences of note combinations), which are quite common in music. As a result, chromagram analysis may be vulnerable to overreliance on contemporaneous (e.g., instantaneous) harmonic structure.

However, in music, tonality is defined not only by how multiple contemporaneous notes sound together but also by how they relate to other notes in time. For example, a leading tone is a note that leads the listener's ear to a different note, often resolving some tonally defined musical tension (e.g., musically driven emotional tension). The technique can be employed with multiple notes sounding one after the other and not at the same time (e.g., with no two notes being played within the same time frame). In music theory, musicologists refer to this phenomenon as functional harmony.

In some examples, a transchromagram is a data structure (e.g., a matrix) that can be used to characterize audio data. Furthermore, such characterization may be a basis on which to identify, classify, analyze, represent, or otherwise describe the audio data, and transchromagrams of various audio data can be compared or otherwise analyzed for similarity to identify, select, suggest, or recommend audio data of varying degrees of similarity (e.g., identical, nearly identical, tonally similar, having similar structures, having similar genres, or having a similar moods).

A transchromagram can be derived from any time-domain data, such as audio data that encodes or otherwise represents audio content (e.g., music, such as a song, or noise, such as rhythmic machine-generated noise). As applied to music, a transchromagram can be conceptually described as a probabilistic note transition matrix derived from audio data. Since a chromagram of an audio signal can indicate energies of musical notes (e.g., energies in various frequency bins that each represent a different musical note) as the notes occur over time (e.g., across multiple sequential overlapping or non-overlapping time frames of the audio signal), a transchromagram can be derived from the chromagram of the audio signal.

As discussed in greater detail below, a suitably and specially configured machine generates example transchromagrams by accessing the chromagrams of an audio signal, generating a set of transition matrices based on the chromagrams, with each transition matrix being generated based on a different pair of time frames in the chromagrams, and generating the transchromagram based on the transition matrices (e.g., by averaging or otherwise combining the transition matrices). The machine may be configured to store the transchromagram as metadata of the audio data and use the transchromagram to characterize the audio data (e.g., by characterizing at least the time frames analyzed), and multiple transchromagrams can be compared by the machine (e.g., during similarity analysis) to computationally detect tonally matching, tonally similar, or tonally complementary audio data. In various examples, such a machine may also be configured to perform musical key detection, detection of changes in musical key, musical chord detection, musical genre detection, song identification, derivative song detection (e.g., a live cover version of a studio-recorded song), song structure detection (e.g., detection of AABA structure or other musical patterns), copyright infringement analysis, or any suitable combination thereof.

Reference will now be made in detail to non-limiting examples of this disclosure, examples of which are illustrated in the accompanying drawings. The examples are described below by referring to the drawings.

FIG. 1 is a network diagram illustrating an example network environment 100 suitable for operating an example audio processor machine 110 that is configured to characterize audio using transchromagrams, among other tasks, according to some examples. The example network environment 100 includes the example audio processor machine 110, an example database 115, and example devices 130 and 150 (e.g., client devices), all communicatively coupled to each other via an example network 190. The example audio processor machine 110 of FIG. 1, with or without the example database 115, may form all or part of a cloud 118 (e.g., a geographically distributed set of multiple machines configured to function as a single server), which may form all or part of a network-based system 105 (e.g., a cloud-based server system configured to provide one or more network-based services to the devices 130 and 150). The database 115 may form all or part of a data storage server (e.g., cloud-based) configured to store, update, and provide various audio data (e.g., audio files), metadata that describes such audio data, or any suitable combination thereof. The audio processor machine 110, the database 115, and the devices 130 and 150 may each be implemented in a special-purpose (e.g., specialized) computer system, in whole or in part, as described below with respect to FIG. 10.

Also shown in FIG. 1 are example users 132 and 152. One or both of the users 132 and 152 may be a human user (e.g., a human being), a machine user (e.g., a computer configured by a software program to interact with the device 130 or 150), or any suitable combination thereof (e.g., a human assisted by a machine or a machine supervised by a human). The user 132 is associated with the device 130 and may be a user of the device 130. For example, the device 130 may be a desktop computer, a vehicle computer, a tablet computer, a navigational device, a portable media device, a smart phone, or a wearable device (e.g., a smart watch, smart glasses, smart clothing, or smart jewelry) belonging to the user 132. Likewise, the user 152 is associated with the device 150 and may be a user of the device 150. As an example, the device 150 may be a desktop computer, a vehicle computer, a tablet computer, a navigational device, a portable media device, a smart phone, or a wearable device (e.g., a smart watch, smart glasses, smart clothing, or smart jewelry) belonging to the user 152.

Any of the example systems or machines (e.g., databases and devices) shown in FIG. 1 may be, include, or otherwise be implemented in a special-purpose (e.g., specialized or otherwise non-generic) computer that has been specially modified (e.g., configured or programmed by software, such as one or more software modules of an application, operating system, firmware, middleware, or other program) to perform one or more of the functions described herein for that system or machine. For example, a special-purpose computer system able to implement any one or more of the methodologies described herein is discussed below with respect to FIG. 10, and such a special-purpose computer may accordingly be a means for performing any one or more of the methodologies discussed herein. Within the technical field of such special-purpose computers, a special-purpose computer that has been modified by the structures discussed herein to perform the functions discussed herein is technically improved compared to other special-purpose computers that lack the structures discussed herein or are otherwise unable to perform the functions discussed herein. Accordingly, a special-purpose machine configured according to the systems and methods discussed herein provides an improvement to the technology of similar special-purpose machines.

In some examples, a database is a data storage resource and may store data structured as a text file, a table, a spreadsheet, a relational database (e.g., an object-relational database), a triple store, a hierarchical data store, or any suitable combination thereof. Moreover, any two or more of the systems or machines illustrated in FIG. 1 may be combined into a single system or machine, and the functions described herein for any single system or machine may be subdivided among multiple systems or machines.

The example network 190 of FIG. 1 may be any network that enables communication between or among systems, machines, databases, and devices (e.g., between the example audio processor machine 110 and the example device 130). Accordingly, the example network 190 may be a wired network, a wireless network (e.g., a mobile or cellular network), or any suitable combination thereof. The network 190 may include one or more portions that constitute a private network, a public network (e.g., the Internet), and/or any suitable combination thereof. Accordingly, the network 190 may include one or more portions that incorporate a local area network (LAN), a wide area network (WAN), the Internet, a mobile telephone network (e.g., a cellular network), a wired telephone network (e.g., a plain old telephone system (POTS) network), a wireless data network (e.g., a WiFi network or WiMax network), or any suitable combination thereof. Any one or more portions of the network 190 may communicate information via a transmission medium.

Figure 2:
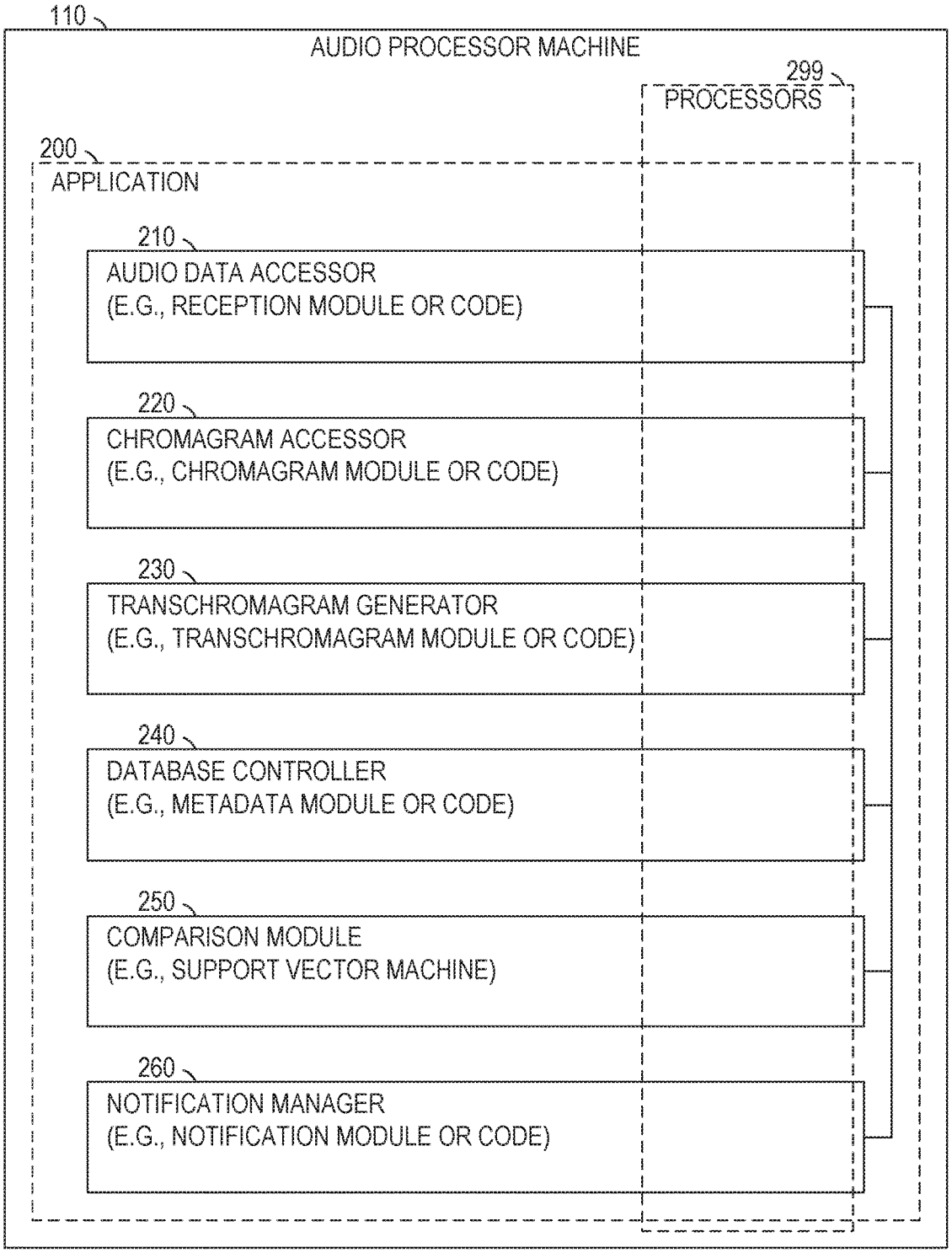
FIG. 2 is a block diagram illustrating example components of the example audio processor machine of FIG. 1, according to some disclosed examples.

FIG. 2 is a block diagram illustrating example components of the example audio processor machine 110 of FIG. 1, according to some examples (e.g., server-side deployments). The example audio processor machine 110 of FIG. 2 is shown as including an example audio data accessor 210, an example chromagram accessor 220, an example transchromagram generator 230, an example database controller 240, an example comparison module 250, and an example notification manager 260, all configured to communicate with each other (e.g., via a bus, shared memory, or a switch). The example audio data accessor 210 of FIG. 2 may be or include an audio data reception module, audio data accessing machine-readable instructions, and/or any suitable combination thereof. The example chromagram accessor 220 of FIG. 2 may be or include a chromagram access module, chromagram accessing machine-readable instructions, and/or any suitable combination thereof. In some examples, the example chromagram accessor 220 is or includes a chromagram generation module, a chromagram generating machine-readable instructions, and/or any suitable combination thereof. The example transchromagram generator 230 of FIG. 2 may be or include a transchromagram generation module, transchromagram generating machine-readable instructions, and/or any suitable combination thereof. The example database controller 240 of FIG. 2 may be or include a metadata maintenance module, metadata maintaining machine-readable instructions, and/or any suitable combination thereof. The example comparison module 250 of FIG. 2 may be or include a support vector machine, a vector quantizer, a recurrent neural network, a convolutional neural network, a gaussian mixer mode, etc. which may take the example form of machine learning machine-readable instructions. The example notification manager 260 of FIG. 2 may be or include a notification module, notification machine-readable instructions, and/or any suitable combination thereof.

As shown in FIG. 2, the example audio data accessor 210, the example chromagram accessor 220, the example transchromagram generator 230, the example database controller 240, the example comparison module 250, and the example notification manager 260 may form all or part of an application 200 (e.g., a software application or other computer program) that is stored (e.g., installed) on the audio processor machine 110 or is otherwise accessible for execution by the audio processor machine 110 (e.g., stored on a computer-readable storage device or disk, stored and served by the database 115, etc.). In some examples, one or more example processors 299 (e.g., hardware processor(s), digital processor(s), analog or digital circuit(s), logic circuits, programmable processor(s), programmable controller(s), graphics processing unit(s) (GPU(s)), digital signal processor(s) (DSP(s)), application specific integrated circuit(s) (ASIC(s)), programmable logic device(s) (PLD(s)), field programmable gate array(s) (FPGA(s)), field programmable logic device(s) (FPLD(s)), and/or any suitable combination thereof) may be included (e.g., temporarily or permanently) to implement the application 200, the audio data accessor 210, the chromagram accessor 220, the transchromagram generator 230, the database controller 240, the comparison module 250, the notification manager 260, and/or any suitable combination thereof.

While an example manner of implementing the example audio processor machine 110 of FIG. 1 is illustrated in FIG. 2, one or more of the elements, processes and/or devices illustrated in FIG. 2 may be combined, divided, re-arranged, omitted, eliminated and/or implemented in any other way. Further, the example audio data accessor 210, the example chromagram accessor 220, the example transchromagram generator 230, the example database controller 240, the example comparison module 250, the example notification manager 260 and/or, more generally, the example audio processor machine 110 of FIG. 2 may be implemented by hardware, software, firmware and/or any combination of hardware, software and/or firmware. Thus, for example, any of the example audio data accessor 210, the example chromagram accessor 220, the example transchromagram generator 230, the example database controller 240, the example comparison module 250, the example notification manager 260 and/or, more generally, the example audio processor machine 110 could be implemented by one or more analog or digital circuit(s), logic circuits, programmable processor(s), programmable controller(s), GPU(s), DSP(s), ASIC(s), PLD(s), FPGA(s), and/or FPLD(s). When reading any of the apparatus or system claims of this patent to cover a purely software and/or firmware implementation, at least one of the example, audio data accessor 210, the example chromagram accessor 220, the example transchromagram generator 230, the example database controller 240, the example comparison module 250, the example notification manager 260 and/or, more generally, the example audio processor machine 110 is/are hereby expressly defined to include a non-transitory computer readable storage device or storage disk such as a memory, a digital versatile disk (DVD), a compact disc (CD), a Blu-ray disk, etc. including the software and/or firmware. Further still, the example audio processor machine 110 of FIG. 2 may include one or more elements, processes and/or devices in addition to, or instead of, those illustrated in FIG. 2, and/or may include more than one of any or all the illustrated elements, processes and devices.

Figure 3:
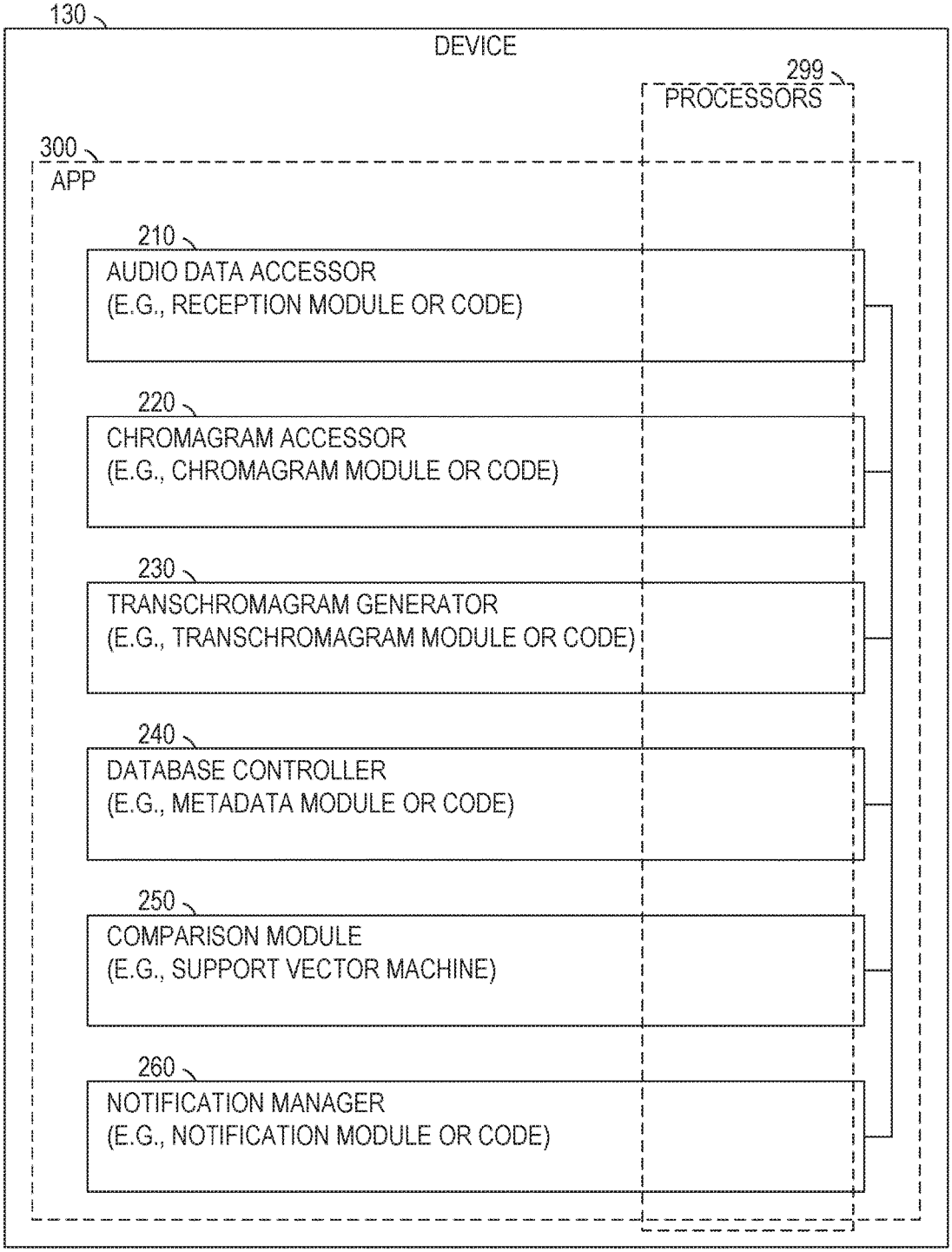
FIG. 3 is a block diagram illustrating example components of an example device suitable for performing one or more of the example operations described herein for the example audio processor machine of FIG. 1, according to some disclosed examples.

FIG. 3 is a block diagram illustrating example components of the example device 130 of FIG. 1, which may be configured to perform one or more of the example operations described herein for the example audio processor machine 110 of FIG. 1, according to some examples (e.g., client-side deployments). The example device 130 of FIG. 3 is shown as including the example audio data accessor 210, the example chromagram accessor 220, the example transchromagram generator 230, the example database controller 240, the example comparison module 250, and the example notification manager 260, all configured to communicate with each other (e.g., via a bus, shared memory, and/or a switch).

As shown in FIG. 3, the example audio data accessor 210, the example chromagram accessor 220, the example transchromagram generator 230, the example database controller 240, the example comparison module 250, and the example notification manager 260 may form all or part of an app 300 (e.g., machine-readable instructions, a mobile app) that is stored (e.g., installed) on the device 130 (e.g., responsive to or otherwise as a result of data being received from the device 130 via the network 190) or is otherwise accessible for execution by the device 130 (e.g., stored in a computer-readable storage device or disk, and/or stored and served by the database 115). In some examples, one or more example processors 299 (e.g., hardware processor(s), digital processor(s), analog or digital circuit(s), logic circuits, programmable processor(s), programmable controller(s), GPU (s), DSP(s), ASIC(s), PLD(s), FPGA(s), FPLD(s), and/or any suitable combination thereof) may be included (e.g., temporarily or permanently) to implement the example app 300, the example audio data accessor 210, the example chromagram accessor 220, the example transchromagram generator 230, the example database controller 240, the example comparison module 250, the example notification manager 260, and/or any suitable combination thereof.

While an example manner of implementing the example device 130 of FIG. 1 is illustrated in FIG. 3, one or more of the elements, processes and/or devices illustrated in FIG. 3 may be combined, divided, re-arranged, omitted, eliminated and/or implemented in any other way. Further, the example audio data accessor 210, the example chromagram accessor 220, the example transchromagram generator 230, the example database controller 240, the example comparison module 250, the example notification manager 260 and/or, more generally, the example device 130 of FIG. 3 may be implemented by hardware, software, firmware and/or any combination of hardware, software and/or firmware. Thus, for example, any of the example audio data accessor 210, the example chromagram accessor 220, the example transchromagram generator 230, the example database controller 240, the example comparison module 250, the example notification manager 260 and/or, more generally, the example device 130 could be implemented by one or more analog or digital circuit(s), logic circuits, programmable processor(s), programmable controller(s), GPU(s), DSP(s), ASIC(s), PLD(s), FPGA(s), and/or FPLD(s). When reading any of the apparatus or system claims of this patent to cover a purely software and/or firmware implementation, at least one of the example, audio data accessor 210, the example chromagram accessor 220, the example transchromagram generator 230, the example database controller 240, the example comparison module 250, the example notification manager 260 and/or, more generally, the example device 130 is/are hereby expressly defined to include a non-transitory computer readable storage device or storage disk such as a memory, a DVD, a CD, a Blu-ray disk, etc. including the software and/or firmware. Further still, the example audio processor machine 110 of FIG. 3 may include one or more elements, processes and/or devices in addition to, or instead of, those illustrated in FIG. 3, and/or may include more than one of any or all the illustrated elements, processes and devices.

Any one or more of the components (e.g., modules) described herein may be implemented using hardware alone (e.g., one or more of the processors 299), or a combination of hardware and software. For example, any component described herein may physically include an arrangement of one or more of the example processors 299 (e.g., a subset of or among the processors 299) configured to perform the operations described herein for that component. As another example, any component described herein may include software, hardware, or both, that configure an arrangement of one or more of the processors 299 to perform the operations described herein for that component. Accordingly, different components described herein may include and configure different arrangements of the processors 299 at different points in time or a single arrangement of the processors 299 at different points in time. Each component (e.g., module) described herein is an example of a means for performing the operations described herein for that component. Moreover, any two or more components described herein may be combined into a single component, and the functions described herein for a single component may be subdivided among multiple components. Furthermore, according to various examples, components described herein as being implemented within a single system or machine (e.g., a single device) may be distributed across multiple systems or machines (e.g., multiple devices).

Figure 4:
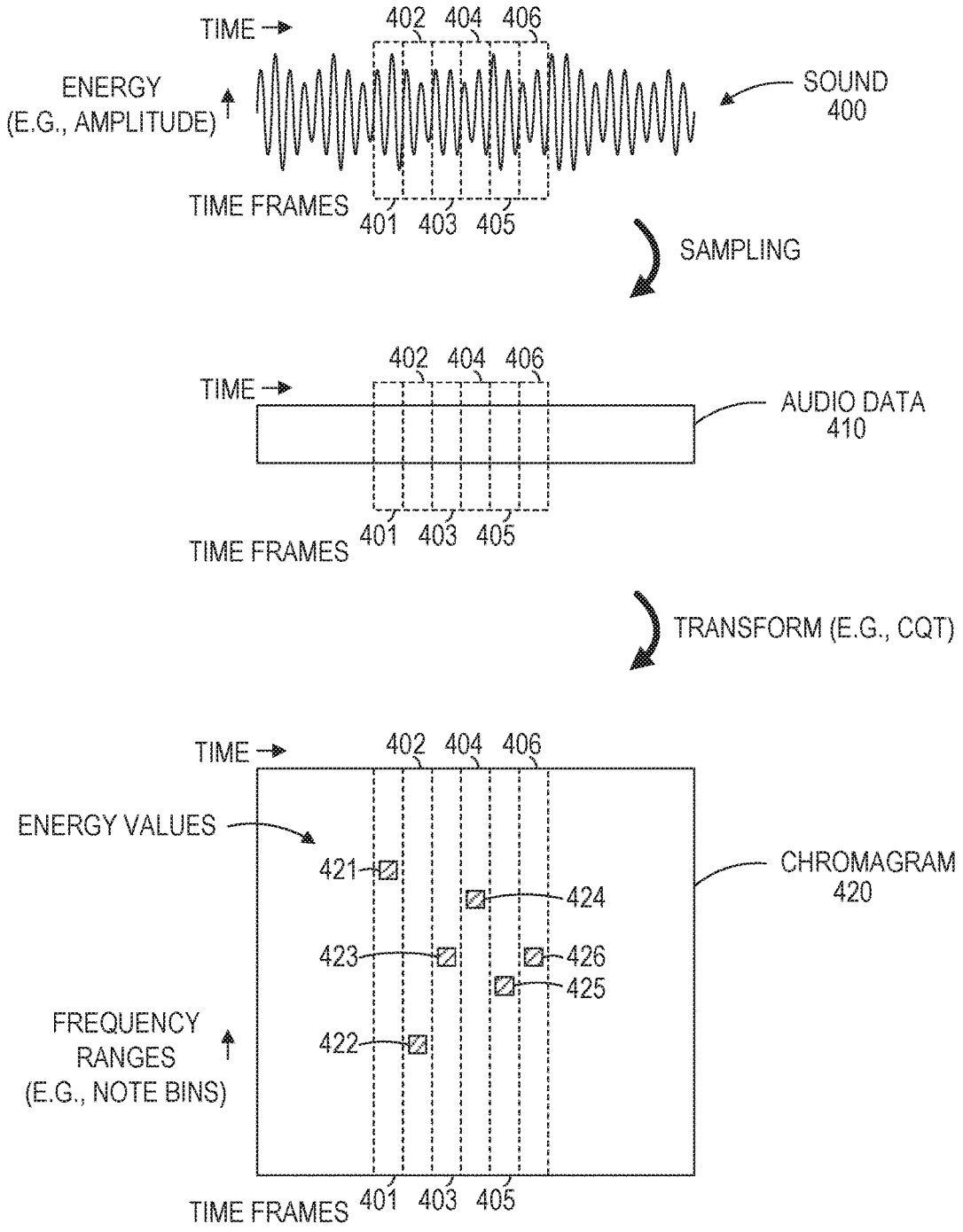
FIGS. 4-6 are conceptual diagrams illustrating example generation of an example transchromagram from example time-series data, such as audio data, according to some disclosed examples.
Figure 5:
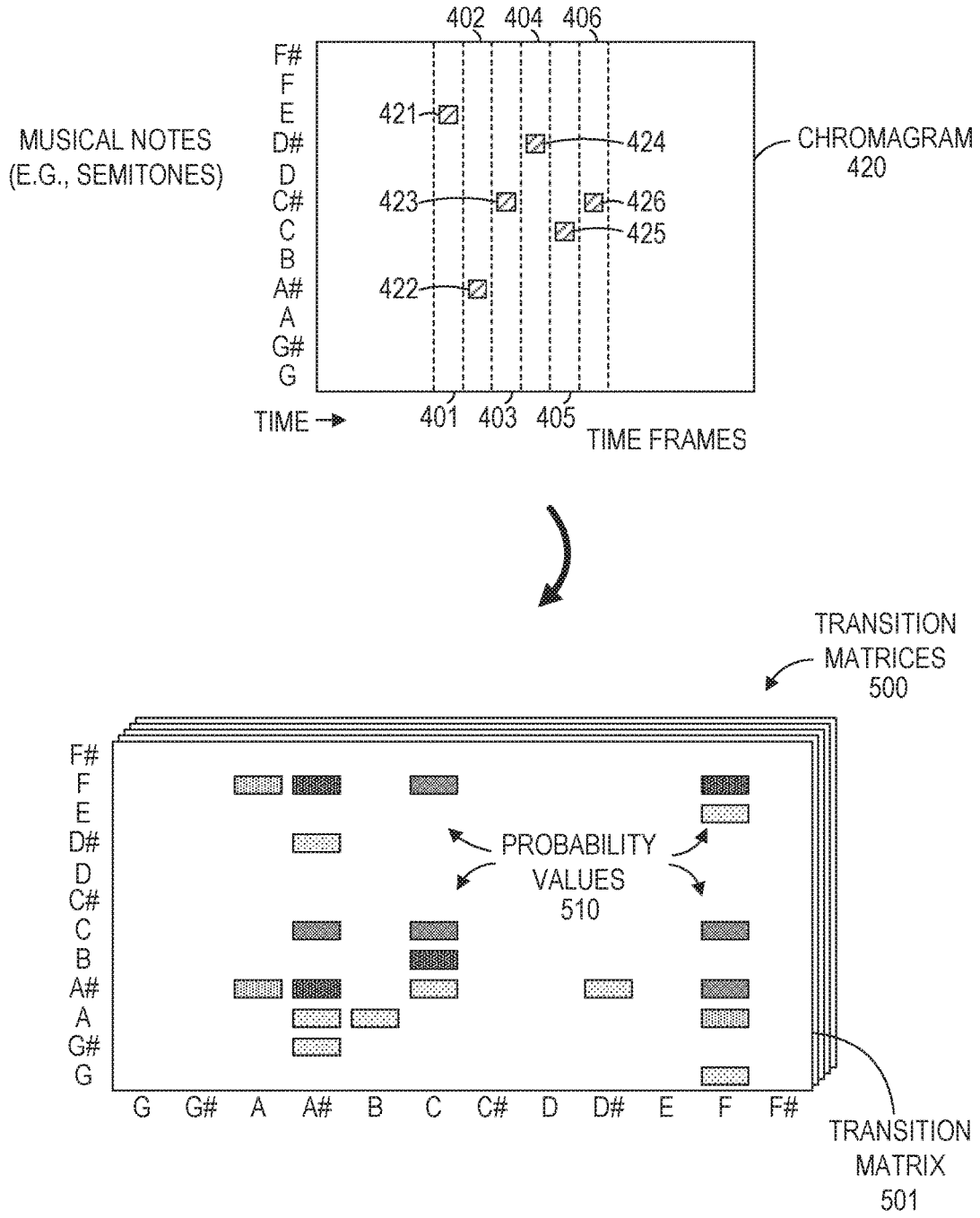
Figure 6:
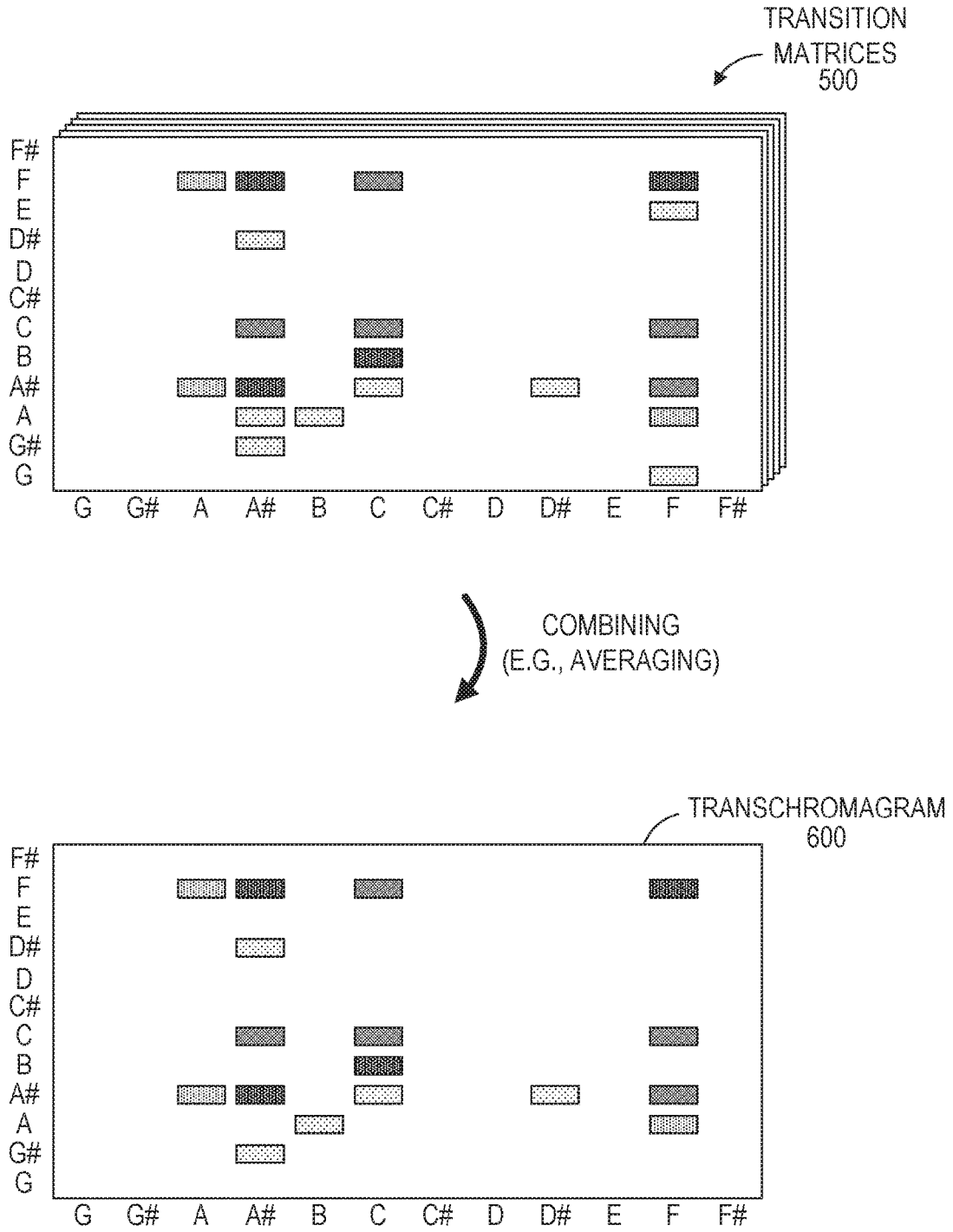

FIGS. 4-6 are conceptual diagrams illustrating an example transchromagram generation based on time-series data, such as audio data, according to some examples. Starting with FIG. 4, an example sound 400 is an example acoustic waveform that represents variations in amplitudes of acoustic energy over time, and portions of the example sound 400 can be apportioned into a set of example sequential time frames 401, 402, 403, 404, 405, and 406. The example time frames 401-406 may span uniform periods of time (e.g., durations of 40 ms, 80 ms, 240 ms, 1 s, 5 s, 10 s, 60 s, 180 s, etc.), according to various examples, and may be overlapping or non-overlapping, again according to various examples. The amplitudes of the sound 400 can then be represented digitally as example audio data 410 (e.g., via sampling), in which each of the time frames 401-406 (e.g., the time frame 401) contains a digital representation of the amplitudes for that time frame (e.g., the time frame 401).

As shown in the example of FIG. 4, the audio data 410 is mathematically processed by applying a mathematical transform (e.g., a constant Q transform (CQT), a wavelet transform, a Fast Fourier Transform (FFT), etc. and/or any suitable combination thereof) to portions (e.g., the time frames 401-406) of the audio data 410 to obtain frequency information for each portion. Accordingly, with access to the audio data 410 (e.g., stored in the database 115), the audio processor machine 110 generates (e.g., calculates) mathematical transforms (e.g., CQTs) of the time frames 401-406 of the audio data 410. The transforms are combined by the example audio processor machine 110 to form a chromagram 420 of the audio data 410. The chromagram 420 indicates energy values 421, 422, 423, 424, 425, and 426 occurring at various frequency ranges for various corresponding time frames 401-406 of the audio data 410. The frequency ranges may take the example form of frequency bins that each correspond to a different span of frequencies. For example, the frequency ranges may be musical note bins that each correspond to a different musical note among a set of musical notes (e.g., semitones A, Bb, B, C, Db, D, Eb, E, F, Gb, G, and Ab, spanning one or more musical octaves) that span one or more musical octaves.

As shown in the example of FIG. 5, according to various examples, the frequency ranges in the example chromagram 420 represent musical note bins that each correspond to a different musical note (e.g., semitones F, F#, G, G#, A, A#, B, C, C#, D, D#, and E, spanning one or more musical octaves). Thus, in such examples, the energy values 421-426 indicate musical notes (e.g., semitones) and their corresponding significance (e.g., energy, amplitudes, loudness, or perceivable strength) within their corresponding time frames 401-406 of the audio data 410.

As further shown in FIG. 5, in accordance with various examples of the systems and methods described herein, a set of one or more example transition matrices 500 can be generated (e.g., calculated by the example audio processor machine 110) based on the chromagram 420. Each transition matrix in the set of example transition matrices 500 is generated based on two or more time frames (e.g., two or more of the time frames 401-406) in the audio data 410. In various examples, the two or more time frames used to generate a transition matrix are sequential (e.g., two adjacent time frames, such as the time frames 401 and 402, or multiple sequential time frames, such as the time frames 403-406 in order). In other examples, non-sequential time frames (e.g., the time frames 401, 403, and 405) are used to generate a transition matrix.

As an illustrative example of a single transition matrix, FIG. 5 depicts an example two-dimensional (2D) transition matrix 501 among the example transition matrices 500, and the transition matrices 500 contain 2D transition matrices. The example 2D transition matrix 501 of FIG. 5 has been generated based on two time frames (e.g., the example adjacent time frames 401 and 402) of the example chromagram 420 and indicates (e.g., by inclusion) a set of example probability values 510 that quantify and specify probabilities (e.g., likelihoods) of a first musical note (e.g., a starting note) transitioning to a second musical note (e.g., an ending note). For example, the transition matrix 501 may be generated based on a pair of time frames that includes the time frame 401 (e.g., an anterior time frame) and the time frame 402 (e.g., a posterior time frame), and the transition matrix 501 may indicate and include the example probability values 510, wherein each of the probability values 510 indicates a separate probability that one musical note (e.g., F) transitions to another musical note (e.g., A) across the two time frames 401 and 402.

According to some examples, a transition matrix (e.g., similar to the transition matrix 501) may be a three-dimensional (3D) transition matrix, and the transition matrices 500 contain 3D transition matrices. An example 3D transition matrix is generated from three time frames (e.g., the example sequential time frames 401, 402, and 403) of the example chromagram 420 and indicates probability values (e.g., similar to the example probability values 510) that quantify and specify probabilities of a first musical note (e.g., a starting note) transitioning to a second musical note (e.g., an intermediate note) and then transitioning to a third musical note (e.g., an ending note).

Similarly, according to certain examples, a transition matrix (e.g., similar to the transition matrix 501) may be a four-dimensional (4D) transition matrix, and the transition matrices 500 may contain 4D transition matrices. An example 4D transition matrix is generated from four time frames (e.g., the example sequential time frames 401, 402, 403, and 404) of the example chromagram 420 and indicates probability values (e.g., similar to the example probability values 510) that quantify and specify probabilities of a first musical note (e.g., a starting note) transitioning to a second musical note (e.g., a first intermediate note), then to a third musical note (e.g., a second intermediate note), and then to a fourth musical note (e.g., an ending note).

Furthermore, according to various examples, a transition matrix (e.g., similar to the example transition matrix 501) may be a five-dimensional (5D) transition matrix, and the transition matrices 500 may contain 5D transition matrices. An example 5D transition matrix is generated from five time frames (e.g., sequential time frames 401, 402, 403, 404, and 405) of the chromagram 420 and indicates probability values (e.g., similar to the example probability values 510) that quantify and specify probabilities of a first musical note (e.g., a starting note) transitioning to a second musical note (e.g., a first intermediate note), then to a third musical note (e.g., a second intermediate note), then to a fourth musical note (e.g., a third intermediate note), and then to a fifth musical note (e.g., an ending note). The present disclosure additionally contemplates transition matrices of even higher dimensionality (e.g., six-dimensional, seven-dimensional, eight-dimensional, etc. transition matrices).

As shown in FIG. 6, the example transition matrices 500 (e.g., 2D, 3D, 4D, 5D, etc. matrices) are combined by the example audio processor machine 110 (e.g., with or without additional processing) to generate an example transchromagram 600. For example, the audio processor machine 110 may generate the example transchromagram 600 by averaging the example transition matrices 500 together (e.g., by calculating a weight or non-weighted average or mean matrix). Thus, the generated transchromagram 600 may be a mean matrix that indicates average probability values (e.g., averages of values similar to the example probability values 510), and such average probability values may quantify and specify average probabilities of transitions among musical notes within the time frames 401-406 of the audio data 410.

As noted above, in various examples, the resulting example transchromagram 600 of FIG. 6 is a probabilistic note transition matrix derived from the example audio data 410. Accordingly, the transchromagram 600 quantifies and specifies probabilities of certain indicated note transitions through the analyzed time frames (e.g., the time frames 401-406) of the audio data 410. In this manner, the example transchromagram 600 can be used (e.g., by the example audio processor machine 110, the example device 130, or both) to describe, identify, or otherwise characterize the audio data 410 or at least the analyzed portions thereof (e.g., the time frames 401-406). For example, the transchromagram 600 may be stored in the example database 115 as metadata (e.g., an identifier or a descriptor) of the audio data 410 or at least the time frames 401-406 thereof.

In examples where the example transchromagram 600 is generated by combining 2D transition matrices, the transchromagram 600 may be described as a second-order transchromagram. Similarly, where the example transchromagram 600 is generated from 3D transition matrices, the transchromagram 600 may be described as a third-order transchromagram; where the example transchromagram 600 is generated from 4D transition matrices, the transchromagram 600 may be described as a fourth-order transchromagram; where the example transchromagram 600 is generated by combining 5D transition matrices, the transchromagram 600 may be described as a fifth-order transchromagram; and so on.

Figure 7:
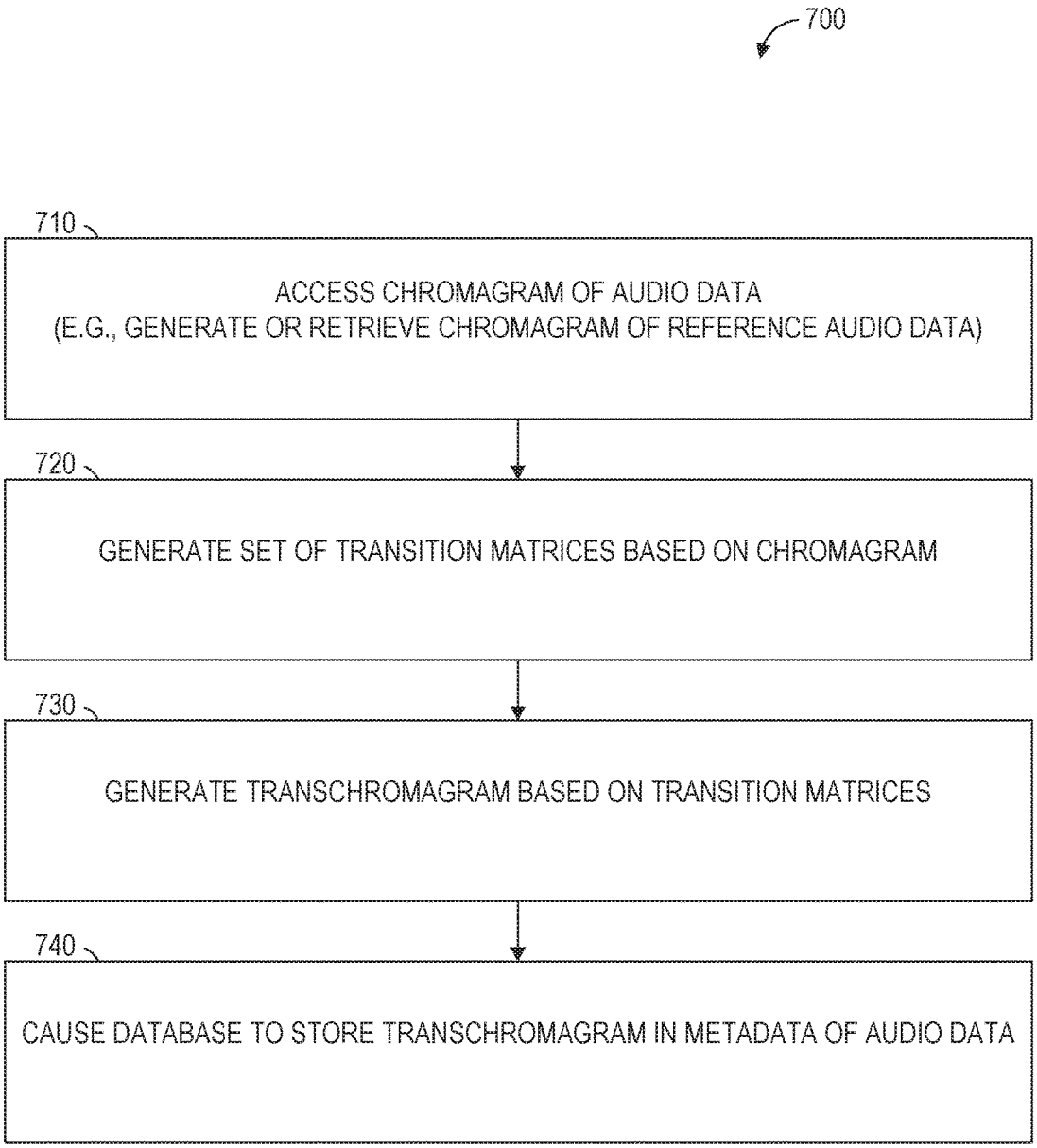
FIGS. 7-9 are flowcharts illustrating machine-readable instructions that may be executed to implement the example audio processor machine of FIGS. 1 and/or 2, and/or the example device of FIGS. 1 and/or 3 to characterize audio using transchromagrams.
Figure 8:
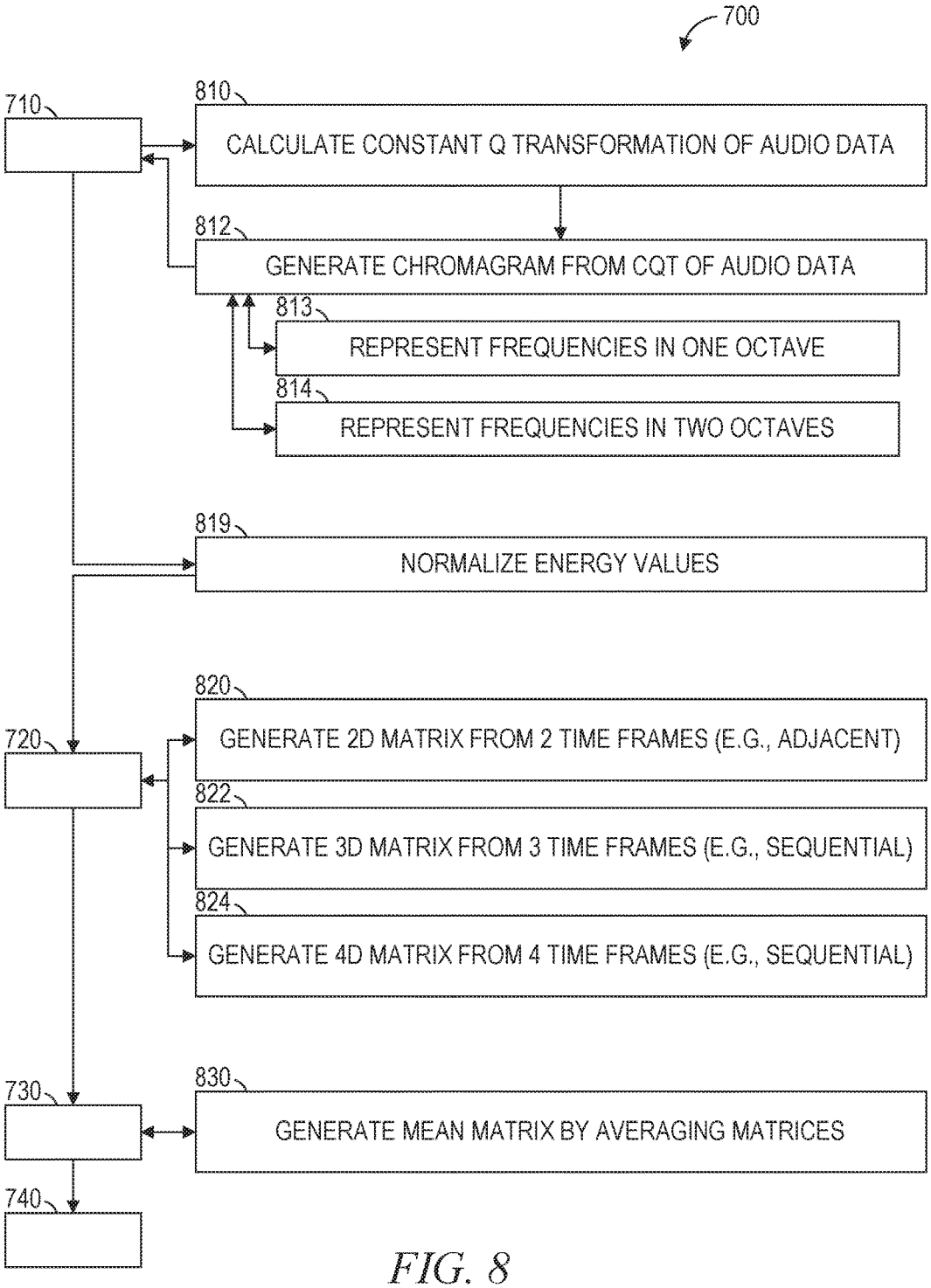
Figure 9:
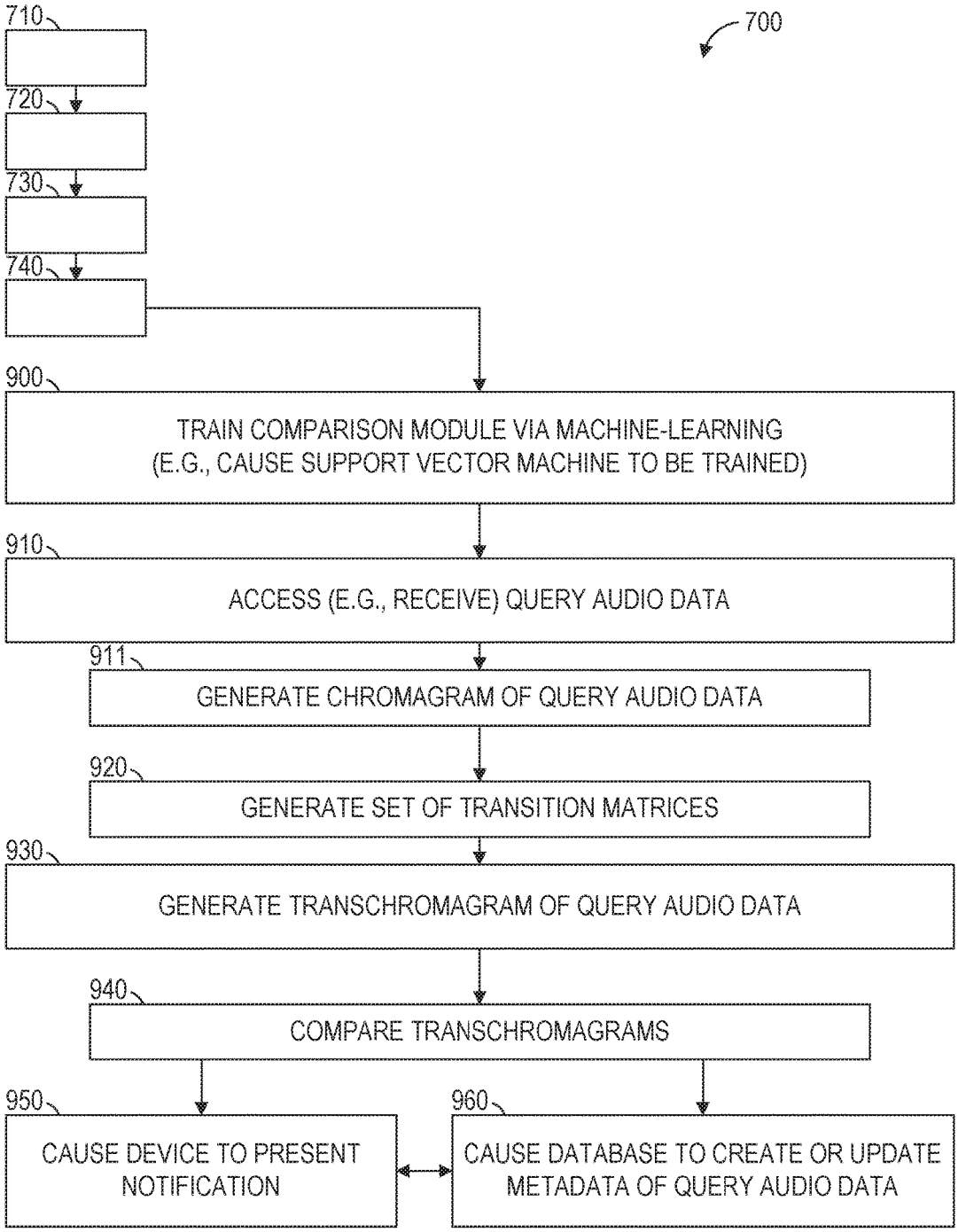

FIGS. 7-9 are flowcharts illustrating machine-readable instructions for implementing operations of the audio processor machine 110 or the device 130 in performing a method 700 that characterizes the audio data 410 using the transchromagram 600, according to some examples. Operations in the method 700 may be performed using components (e.g., modules) described above with respect to FIGS. 2 and 3, using one or more processors (e.g., microprocessors or other hardware processors), or using any suitable combination thereof. As shown in FIG. 7, the method 700 includes operations 710, 720, 730, and 740.

In this example, the machine-readable instructions comprise a program for execution by a processor such as the processor 1002 shown in the example processor platform 1000 discussed below in connection with FIG. 10. The program may be embodied in software stored on a non-transitory computer-readable storage medium such as a CD, a floppy disk, a hard drive, a DVD, a Blu-ray disk, or a memory associated with the processor 1002, but the entire program and/or parts thereof could alternatively be executed by a device other than the processor 1002 and/or embodied in firmware or dedicated hardware. Further, although the example program is described with reference to the flowcharts illustrated in FIGS. 7-9, many other methods of implementing the example audio processor machine 110 or the device 130 may alternatively be used. For example, the order of execution of the blocks may be changed, and/or some of the blocks described may be changed, eliminated, or combined. Additionally or alternatively, any or all the blocks may be implemented by one or more hardware circuits (e.g., discrete and/or integrated analog and/or digital circuitry, an FPGA, a PLD, a FPLD, an ASIC, a comparator, an operational-amplifier (op-amp), a logic circuit, etc.) structured to perform the corresponding operation without executing software or firmware.

As mentioned above, the example processes of FIGS. 7-9 may be implemented using coded instructions (e.g., computer and/or machine-readable instructions) stored on a non-transitory computer and/or machine-readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term non-transitory computer readable medium is expressly defined to include any type of computer readable storage device and/or storage disk and to exclude propagating signals and to exclude transmission media.

In operation 710, the example chromagram accessor 220 of FIGS. 2 and/or 3 accesses (e.g., retrieves) the example chromagram 420 of the audio data 410. The chromagram 420 may be accessed from the database 115, from the device 130, from the audio processor machine 110, or any suitable combination thereof. As noted above, the chromagram 420 indicates the energy values 421-426 that occur in corresponding time frames 401-406 of the audio data 410 at corresponding frequency ranges (e.g., musical note bins). The frequency ranges may partition a set of musical octaves into musical notes (e.g., semitones F, F#, G, A#, B, C, C#, D, D#, and E) that are each represented by a different frequency range (e.g., a specific frequency bin that represents a corresponding specific musical note) among the frequency ranges.

In operation 720, the example transchromagram generator 230 of FIGS. 2 and/or 3 generates (e.g., calculates) the example transition matrices 500 based on the example chromagram 420 accessed in operation 710. Specifically, the generation of each transition matrix (e.g., the example transition matrix 501) is based on a different group (e.g., at least a pair, such as a pair, a trio, a quartet, a quintet, etc.) of time frames (e.g., the time frames 401 and 402) in the audio data 410. According to some examples, each group has sequential time frames, while in other examples, non-sequential time frames are used. Each transition matrix (e.g., the transition matrix 501) in the transition matrices 500 therefore corresponds to its own different group (e.g., pair) of time frames and indicates probabilities (e.g., the probability values 510) that anterior (e.g., earlier occurring) musical notes in an anterior time frame in the group (e.g., a first time frame of the pair) transition to posterior (e.g., later occurring) musical notes in a posterior time frame in the group (e.g., a second timeframe of the pair).

As a 2D example, a first example 2D transition matrix (e.g., the example transition matrix 501) may be generated from a first pair of time frames (e.g., the example sequential time frames 401 and 402); a second example 2D transition matrix may be generated from a second pair of time frames (e.g., the example sequential time frames 402 and 403); a third example 2D transition matrix may be generated from a third pair of time frames (e.g., the example sequential time frames 403 and 404); and so on. As a 3D example, a first example 3D transition matrix (e.g., the example transition matrix 501) may be generated from a first trio of time frames (e.g., the example sequential time frames 401, 402, and 403); a second example 3D transition matrix may be generated from a second trio of time frames (e.g., the example sequential time frames 402, 403, and 404); a third example 3D transition matrix may be generated from a third trio of time frames (e.g., the example sequential time frames 403, 404, and 405); and so on. As a 4D example, a first example 4D transition matrix (e.g., the example transition matrix 501) may be generated from a first quartet of time frames (e.g., the example sequential time frames 401, 402, 403, and 404); a second example 4D transition matrix may be generated from a second quartet of time frames (e.g., the example sequential time frames 402, 403, 404, and 405); a third example 4D transition matrix may be generated from a third quartet of time frames (e.g., the example sequential time frames 403, 404, 405, and 406); and so on. Similarly, as a 5D example, different quintets (e.g., sequential quintets) of time frames may be used to generate each individual 5D transition matrix (e.g., transition matrix 501).

Higher-order transition matrices (e.g., the example transition matrices 500) are also contemplated, for example, with six-dimensional (6D) transition matrices (e.g., the example transition matrices 500) being generated from different sextets of time frames, with seven-dimensional (7D) transition matrices (e.g., the example transition matrices 500) being generated from different septets of time frames, with eight-dimensional (8D) transition matrices (e.g., the example transition matrices 500) being generated from different octets of time frames, with nine-dimensional (9D) transition matrices (e.g., the example transition matrices 500) being generated from different nonets of time frames, with ten-dimensional (10D) transition matrices (e.g., the example transition matrices 500) being generated from different dectets of time frames, and so on.

In operation 730, the example transchromagram generator 230 of FIGS. 2 and/or generates the example transchromagram 600 of the example chromagram 420. The generation of the example transchromagram 600 is based on the example transition matrices 500 generated in operation 720. As noted above, the transition matrices 500 were each generated based on a different group (e.g., at least a pair) among the time frames (e.g., among the example time frames 401-406) of the audio data 410. For example, the example transchromagram generator 230 of FIGS. 2 and/or 3 may mathematically combine the example transition matrices 500, with or without additional pre-processing or post-processing operations, to form the example transchromagram 600.

In operation 740, the example database controller 240 of FIGS. 2 and/or 3 causes the example database 115 of FIGS. 2 and/or 3 to store the generated transchromagram 600. For example, the example database controller 240 may command, request, or otherwise cause the example database 115 to store the transchromagram 600 within metadata that describes the audio data 410. Accordingly, the transchromagram 600 may be stored as an identifier of the audio data 410, an example descriptor of the audio data 410, or any suitable combination thereof. That is, the database 115 may be caused to label the transchromagram 600 as an identifier of the audio data 410, a descriptor of the audio data 410, or both.

As shown in FIG. 8, in addition to any one or more of the operations previously described, the method 700 may include one or more of operations 810, 812, 813, 814, 819, 820, 822, 824, and 830. In some examples, the accessing of the chromagram 420 in operation 710 includes generation of the chromagram 420 (e.g., by the example chromagram accessor 220 functioning as a chromagram generator). Accordingly, one or more of operations 810, 812, 813, and 814 may be performed as part (e.g., a precursor task, a subroutine, or a portion) of operation 710, in which the chromagram accessor 220 accesses the chromagram 420.

In operation 810, the example chromagram accessor 220 of FIGS. 2 and/or 3 calculates a mathematical transform of the audio data 410. For example, the chromagram accessor 220 may calculate a transform (e.g., a CQT) of the audio data 410.

In operation 812, the example chromagram accessor 220 generates (e.g., creates) the example chromagram 420 of the audio data 410 based on the transform calculated in operation 810. This may be performed in a manner similar to that described above with respect to FIG. 4. The chromagram 420 may be created in memory (e.g., within the audio processor machine 110 or the device 130), in the database 115, or any suitable combination thereof. In some examples, the chromagram 420 is created at a first point in time and then accessed (e.g., by reading or retrieving) at a second point in time, all during the performance of operation 710.

According to various examples, the chromagram 420 may represent a set of frequency ranges (e.g., musical note bins) that span one or more musical octaves. Thus, in some examples, an operation 813 is performed as part of operation 812. In operation 813, the generation of the chromagram 420 by the example chromagram accessor 220 includes representing both the fundamental frequencies of the audio data 410 and the overtone frequencies of the audio data 410 within one musical octave. Since a single musical octave may include twelve equal-tempered semitone notes, the frequency ranges of the chromagram 420 may partition the one musical octave into twelve equal-tempered semitone notes.

However, in some alternative examples, the set of frequency ranges spans two musical octaves, and an operation 814 is performed as part of operation 812. In operation 814, the generation of the chromagram 420 by the example chromagram accessor 220 of FIGS. 2 and/or 3 includes representing both the fundamental frequencies of the audio data 410 and the overtone frequencies of the audio data 410 within two musical octaves. Accordingly, the frequency ranges of the chromagram 420 may partition the two musical octaves into twenty-four equal-tempered semitone notes. Examples in which the set of frequency ranges spans three or more musical octaves are also contemplated.

According to certain examples, the energy values (e.g., energy values 421-426) indicated in the chromagram 420 are normalized prior to generation of the transition matrices 500 to be performed in operation 720. Thus, as shown in FIG. 8, an operation 819 may be performed between operations 710 and 720. In operation 819, the example chromagram accessor 220 of FIGS. 2 and/or 3 normalizes the energy values (e.g., the energy values 421-426) of the accessed chromagram 420. For example, the energy values may be normalized to fit a range between zero and unity. In examples that include operation 819, the generation of the transition matrices 500 in operation 720 is based on the normalized energy values (e.g., ranging between zero and unity).

As shown in FIG. 8, according to some examples, an operation 820 may be performed as part of operation 720, in which the example transchromagram generator 230 of FIGS. 2 and/or 3 generates the transition matrices 500. In operation 820, the example transchromagram generator 230 generates a 2D transition matrix (e.g., transition matrix 501) based on a pair of time frames (e.g., the time frames 401 and 402) selected from the time frames (e.g., the time frames 401-406) of the audio data 410. For example, the pair of time frames may be a sequential pair of adjacent time frames (e.g., the time frames 401 and 402) within the audio data 410. In such examples, the generated 2D transition matrix indicates, among other things, a probability of a first musical note (e.g., F) transitioning to a second musical note (e.g., A) during the sequential pair of adjacent time frames.

As also shown in FIG. 8, according to certain examples, an operation 822 may be performed as part of operation 720, in which the example transchromagram generator 230 of FIGS. 2 and/or 3 generates the transition matrices 500. In operation 822, the example transchromagram generator 230 generates a 3D transition matrix (e.g., the transition matrix 501) based on a trio of time frames (e.g., the time frames 401, 402, and 403) selected from the time frames (e.g., the time frames 401-406) of the audio data 410. For example, the trio of time frames may be a sequential trio of consecutive time frames (e.g., the time frames 401-403) within the audio data 410. In such examples, the generated 3D transition matrix indicates, among other things, a probability of a first musical note (e.g., F) transitioning to a second musical note (e.g., A) and then transitioning to a third musical note (e.g., C) during the sequential trio of consecutive time frames.

As further shown in FIG. 8, according to various examples, an operation 824 may be performed as part of operation 720, in which the example transchromagram generator 230 of FIGS. 2 and/or 3 generates the transition matrices 500. In operation 824, the example transchromagram generator 230 generates a 4D transition matrix (e.g., the transition matrix 501) based on a quartet of time frames (e.g., the time frames 401, 402, 403, and 404) selected from the time frames (e.g., the time frames 401-406) of the audio data 410. For example, the quartet of time frames may be a sequential quartet of consecutive time frames (e.g., the time frames 401-404) within the audio data 410. In such examples, the generated 4D transition matrix indicates, among other things, a probability of a first musical note (e.g., F) transitioning to a second musical note (e.g., A), then transitioning to a third musical note (e.g., C), and then transitioning to a fourth musical note (e.g., E) during the sequential quartet of consecutive time frames.

Since higher-order transition matrices (e.g., the transition matrices 500) are also contemplated, operations that are analogous to operations 820-824 are likewise contemplated for higher-order transition matrices. Such analogous operations may be included in operation 720, in which the example transchromagram generator 230 of FIGS. 2 and/or 3 generates the transition matrices 500. Thus, various examples of the method 700 are capable of supporting transition matrices of higher dimensionality (e.g., 5D, 6D, 7D, 8D, 9D, 10D, and so on).

In some examples, in performing operation 730 to generate the transchromagram 600, the example transchromagram generator 230 of FIGS. 2 and/or 3 may combine the transition matrices 500 by mathematically averaging the transition matrices. Accordingly, as shown in FIG. 8, operation 830 may be performed as part of operation 730. In operation 830, the example transchromagram generator 230 generates (e.g., calculates) a mean transition matrix (e.g., as the transchromagram 600). The generation of the mean transition matrix may be performed by averaging the transition matrices 500 generated in operation 720. Thus, in such examples, the generated transchromagram 600 may be or include the generated mean transition matrix.

As shown in FIG. 9, in addition to any one or more of the operations previously described, the method 700 may include one or more of operations 900, 910, 911, 920, 930, 940, 950, and 960. In several examples, the method 700 compares or otherwise analyzes transchromagrams (e.g., the example transchromagram 600) of various audio data (e.g., the audio data 410) and takes action (e.g., controls a device, such as the device 130) based on such comparison or analysis. Accordingly, one or more of operations 900-960 may be performed after operation 740, in which the example database controller 240 of FIGS. 2 and/or 3 causes the example database 115 to store the transchromagram 600 in or as metadata of the audio data 410.

In some examples that include operation 900, the audio data 410 is or includes reference audio data. Also, the reference audio data may be identified (e.g., by the database 115) by a reference identifier (e.g., a filename or a song name) stored in metadata (e.g., within the database 115) that describes the reference audio data (e.g., the audio data 410). Additionally, the reference audio data may be in a reference musical key indicated by the metadata. Moreover, the reference audio data may contain a reference musical chord indicated by the metadata. According to some example implementations, the reference musical chord is an appreciated musical chord that includes multiple musical notes played one musical note at a time over multiple sequential time frames (e.g., time frames 401-403) of the reference audio data (e.g., audio data 410). Furthermore, the reference audio data may have a reference song structure of multiple sequential song segments (e.g., indicated as AABA, ABAB, or ABABCB), and the reference song structure may be indicated by the metadata that describes the reference audio data. Furthermore still, the reference audio data may exemplify a reference musical genre (e.g., blues, rock, march, or polka) indicated by the metadata that describes the reference audio data.

According to some examples that include operation 900, the transchromagram 600 is or includes a reference transchromagram correlated by the database 115 with the reference audio data (e.g., audio data 410) and its metadata (e.g., reference metadata). In this context, the comparison module 250 performs operation 900 using, for example, machine learning. Machine learning can be used to train, for example, a support vector machine, a vector quantizer, a recurrent neural network, a convolutional neural network, a gaussian mixer mode, etc. For example, a support vector machine may be trained to recognize (e.g., detect or identify) the reference audio data (e.g., the audio data 410) based on the reference transchromagram (e.g., the transchromagram 600). As another example, the support vector machine may be trained to recognize the reference musical key of the reference audio data based on the reference transchromagram. As yet another example, the support vector machine may be trained to recognize the reference musical chord contained in the reference audio data based on the reference transchromagram. As a further example, the support vector machine may be trained to recognize the reference song structure of the reference audio data based on the reference transchromagram. As a still further example, the support vector machine may be trained to recognize the reference musical genre of the reference audio data based on the reference transchromagram.

In some examples, the example comparison module 250 of FIGS. 2 and/or 3 is or includes the support vector machine, and the example comparison module 250 performs operation 900 by executing one or more machine-learning algorithms on a collection (e.g., a library, which may be stored by the example database 115) of reference audio data (e.g., the audio data 410) having corresponding known (e.g., previously generated) reference transchromagrams (e.g., transchromagram 600).

In operation 910, the example audio data accessor 210 of FIGS. 2 and/or 3 accesses (e.g., by receiving) query audio data (e.g., audio data similar to the audio data 410). For example, the query audio data may be accessed from the example database 115, from the example audio processor machine 110, from the example device 130, or any suitable combination thereof. In some examples, the query audio data is provided in a user-submitted query that requests provision of information regarding the query audio data. Such a user-submitted query may be communicated from the example device 130 of FIGS. 1 and/or 3 (e.g., to the example audio processor machine 110 of FIGS. 1 and/or 2).

For example, the query may include a request to identify the query audio data (e.g., audio data similar to the audio data 410), and the example audio data accessor 210 of FIGS. 2 and/or 3 may perform operation 910 by receiving the query audio data to be identified. As another example, the query may include a request to analyze the query audio data, and the example audio data accessor 210 may perform operation 910 by receiving the query audio data to be analyzed.

In operation 911, the example chromagram accessor 220 of FIGS. 2 and/or 3 (e.g., functioning as a chromagram generator) generates a query chromagram (e.g., a chromagram similar to the chromagram 420) of the query audio data (e.g., audio data similar to the audio data 410). This may be performed based on the query audio data and in a manner similar to that described above with respect to operations 810 and 812 (e.g., including operation 813 or 814).

In operation 920, the example transchromagram generator 230 of FIGS. 2 and/or 3 generates a set of query transition matrices (e.g., transition matrices similar to the transition matrices 500) based on the query transchromagram generated in operation 911. This may be performed in a manner similar to that described above with respect to operation 720 (e.g., including a detailed operation described above with respect to FIG. 8).

In operation 930, the example transchromagram generator 230 of FIGS. 2 and/or 3 generates a query transchromagram (e.g., transchromagram similar to the transchromagram 600) of the query chromagram. This may be performed based on the set of query transition matrices generated in operation 920 and in a manner similar to that described above with respect operation 730 (e.g., including operation 830). This may have the effect of generating the query transchromagram based on the query audio data (e.g., audio data similar to the audio data 410).

In operation 940, the example comparison module 250 of FIGS. 2 and/or 3 compares the query transchromagram generated in operation 930 with one or more reference transchromagrams, such as the reference transchromagram discussed above with respect to operation 900. In some examples, the example comparison module 250 causes the example database 115 of FIG. 1 to perform the comparison. This may have the effect of comparing different probabilistic note transition matrices derived from different audio data (e.g., reference audio data and query audio data), and the performed comparison may indicate a degree to which the compared transchromagrams are similar or different.

In operation 950, the example notification manager 260 of FIGS. 2 and/or 3 causes a device (e.g., the device 130 or 150 of FIGS. 1 and/or 3) to present a notification, and the presenting of the notification may be based on the comparison of the query transchromagram (e.g., a transchromagram similar to the transchromagram 600) to the reference transchromagram (e.g., the transchromagram 600) in operation 940. The notification may provide information regarding the query audio data, as requested by a user-submitted query (e.g., as discussed above with respect operation 910).

For example, in response to a request to identify the query audio data (e.g., similar to audio data 410), the example notification manager 260 of FIGS. 2 and/or 3 may cause the example device 130 to present a notification that the query audio data is identified by the same reference identifier (e.g., a file name or song name) as the reference audio data. As another example, in response to a request to analyze the query audio data, the example notification manager 260 may cause the example device 130 to present a notification that the query audio data is in the same reference musical key as the reference audio data. As yet another example, in response to a request to analyze the query audio data, the example notification manager 260 may cause the device 130 to present a notification that the query audio data contains the same reference musical chord as contained in the reference audio data. As a further example, in response to a request to analyze the query audio data, the example notification manager 260 of FIGS. 2 and/or 3 may cause the example device 130 of FIGS. 1 and/or 3 to present a notification that the query audio data has the same reference song structure as the reference audio data. As a still further example, in response to a request to analyze the query audio data, the notification manager 260 may cause the device 130 to present a notification that the query audio data exemplifies the same reference musical genre as the reference audio data.

In operation 960, the example database controller 240 of FIGS. 2 and/or 3 causes a database (e.g., the example database 115 of FIG. 1) to create or update metadata (e.g., query metadata) of the query audio data. This causing of the example database 115 to create or update the metadata of the query audio data may be based on the comparison performed in operation 940 (e.g., based on the indicated degree to which the compared transchromagrams are similar or different).

For example, the example database controller 240 of FIGS. 2 and/or 3 may cause the example database 115 to store the reference identifier of the reference audio data (e.g., audio data 410) in metadata of the query audio data. As another example, the example database controller 240 may cause the database 115 to store an indicator of the reference musical key of the reference audio data in the metadata of the query audio data. As yet another example, the database controller 240 may cause the database 115 to store an indicator of the reference musical chord contained in the reference audio data in the metadata of the query audio data. As a further example, the database controller 240 may cause the database 115 to store an indicator of the reference song structure in the metadata of the query audio data. As a still further example, the database controller 240 may cause the database 115 to store an indicator of the reference musical genre in the metadata of the query audio data.

According to various examples, one or more of the methodologies described herein may facilitate characterization of audio, and in particular, characterization of audio data using transchromagrams. Moreover, one or more of the example methodologies described herein may facilitate identification of audio data based on transchromagrams, analysis of audio data based on transchromagrams, or any suitable combination thereof. Hence, one or more of the example methodologies described herein may facilitate provision of identification and analysis services regarding audio data, as well as convenient and efficient user service in providing notifications and performing maintenance of metadata for audio data, compared to capabilities of pre-existing systems and methods.

When these effects are considered in aggregate, one or more of the example methodologies described herein may obviate a need for certain efforts or resources that otherwise would be involved in characterization of audio, identification of audio, analysis of audio, or other computationally intensive audio processing tasks. Efforts expended by a user in such audio processing tasks may be reduced by use of (e.g., reliance upon) a special-purpose machine that implements one or more of the example methodologies described herein. Computing resources used by one or more systems or machines (e.g., within the example network environment 100 of FIG. 1) may similarly be reduced (e.g., compared to systems or machines that lack the structures discussed herein or are otherwise unable to perform the functions discussed herein). Examples of such computing resources include processor cycles, network traffic, computational capacity, main memory usage, graphics rendering capacity, graphics memory usage, data storage capacity, power consumption, and cooling capacity.

Figure 10:
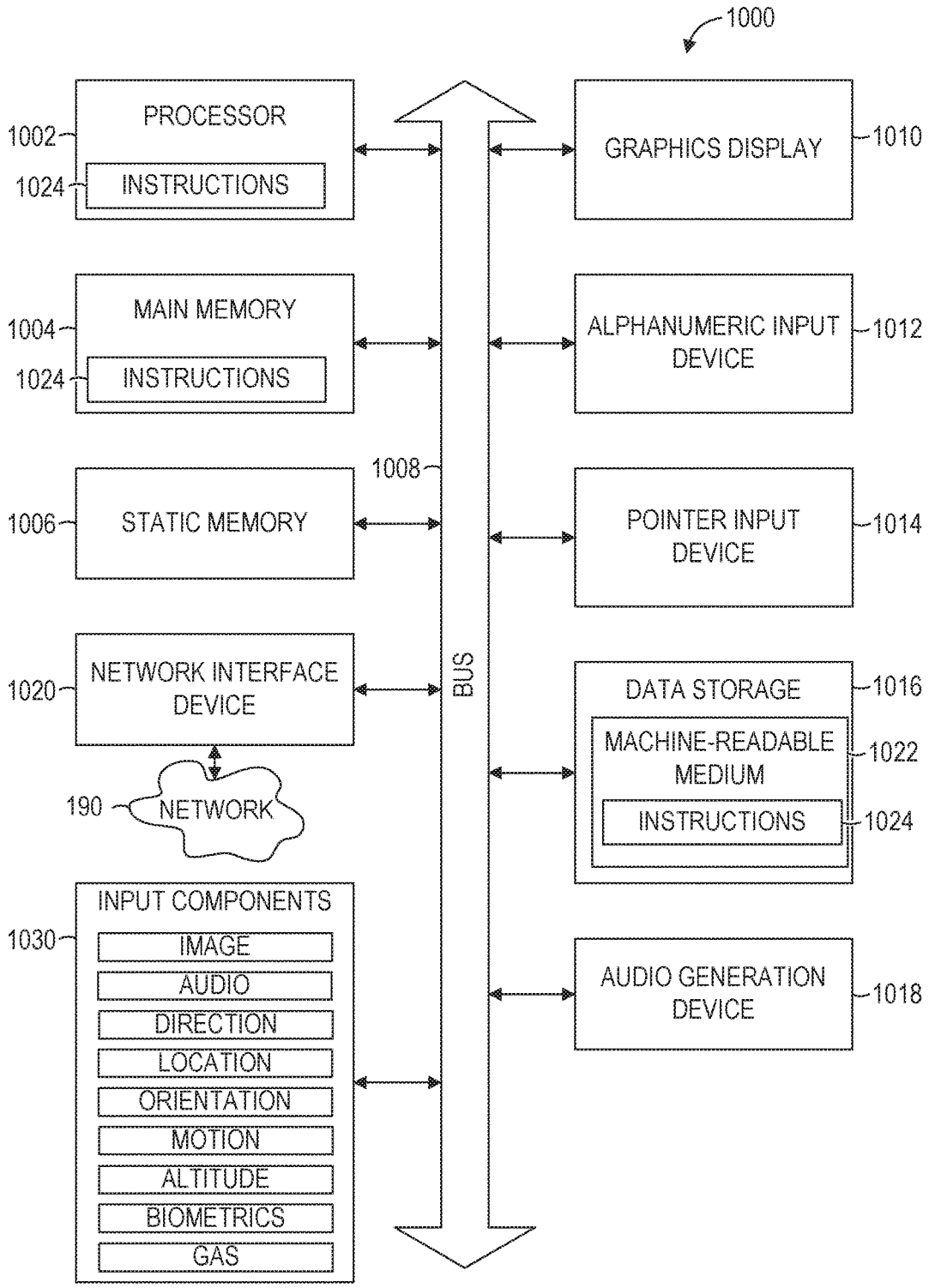
FIG. 10 is a block diagram illustrating components of an example processor platform examples that may execute the machine-readable instructions of FIGS. 7, 8 and/or 9 to perform any one or more of the example methodologies discussed herein.

FIG. 10 is a block diagram illustrating example components of an example machine 1000, according to some examples, able to read machine-readable instructions 1024 from a machine-readable medium 1022 (e.g., a non-transitory machine-readable medium, a machine-readable storage medium, a computer-readable storage medium, or any suitable combination thereof) and perform any one or more of the methodologies discussed herein, in whole or in part. Specifically, FIG. 10 shows the example machine 1000 in the example form of an example computer system (e.g., a computer) within which the machine-readable instructions 1024 (e.g., software, a program, an application, an applet, an app, or other executable code) for causing the example machine 1000 to perform any one or more of the methodologies discussed herein may be executed, in whole or in part.

In some examples, the machine 1000 operates as a standalone device or may be communicatively coupled (e.g., networked) to other machines. In a networked deployment, the example machine 1000 of FIG. 10 may operate in the capacity of a server machine or a client machine in a server-client network environment, or as a peer machine in a distributed (e.g., peer-to-peer) network environment. The example machine 1000 may be a server computer, a client computer, a personal computer (PC), a tablet computer, a laptop computer, a netbook, a cellular telephone, a smart phone, a set-top box (STB), a personal digital assistant (PDA), a web appliance, a network router, a network switch, a network bridge, or any machine capable of executing the instructions 1024, sequentially or otherwise, that specify actions to be taken by that machine. Further, while only a single machine is illustrated, the term "machine" shall also be taken to include any collection of machines that individually or jointly execute the example instructions 1024 to perform all or part of any one or more of the example methodologies discussed herein.

The example machine 1000 of FIG. 10 includes an example processor 1002 (e.g., one or more central processing units (CPUs), one or more graphics processing units (GPUs), one or more digital signal processors (DSPs), one or more application specific integrated circuits (ASICs), one or more radio-frequency integrated circuits (RFICs), or any suitable combination thereof), an example main memory 1004, and an example static memory 1006, which are configured to communicate with each other via an example bus 1008. The example processor 1002 of FIG. 10 contains solid-state digital microcircuits (e.g., electronic, optical, or both) that are configurable, temporarily or permanently, by some or all of the instructions 1024 such that the processor 1002 is configurable to perform any one or more of the example methodologies described herein, in whole or in part. For example, a set of one or more microcircuits of the processor 1002 may be configurable to execute one or more modules (e.g., software modules) described herein. In some examples, the example processor 1002 is a multicore CPU (e.g., a dual-core CPU, a quad-core CPU, an 8-core CPU, a 128-core CPU, etc.) within which each of multiple cores behaves as a separate processor that is able to perform any one or more of the example methodologies discussed herein, in whole or in part. Although the beneficial effects described herein may be provided by the machine 1000 with at least the processor 1002, these same beneficial effects may be provided by a different kind of machine that contains no processors (e.g., a purely mechanical system, a purely hydraulic system, or a hybrid mechanical-hydraulic system), if such a processor-less machine is configured to perform one or more of the methodologies described herein.

The example machine 1000 of FIG. 10 may further include an example graphics display 1010 (e.g., a plasma display panel (PDP), a light emitting diode (LED) display, a liquid crystal display (LCD), a projector, a cathode ray tube (CRT), or any other display capable of displaying graphics or video). The example machine 1000 may also include an example alphanumeric input device 1012 (e.g., a keyboard or keypad), an example pointer input device 1014 (e.g., a mouse, a touchpad, a touchscreen, a trackball, a joystick, a stylus, a motion sensor, an eye tracking device, a data glove, or other pointing instrument), an example data storage 1016, an example audio generation device 1018 (e.g., a sound card, an amplifier, a speaker, a headphone jack, or any suitable combination thereof), and an example network interface device 1020.

The example data storage 1016 of FIG. 10 (e.g., a data storage device) includes the machine-readable medium 1022 (e.g., a tangible and non-transitory machine-readable storage medium) on which are stored the instructions 1024 embodying any one or more of the example methodologies or functions described herein. The instructions 1024 may also reside, completely or at least partially, within the main memory 1004, within the static memory 1006, within the processor 1002 (e.g., within the processor's cache memory), or any suitable combination thereof, before or during execution thereof by the machine 1000. Accordingly, the main memory 1004, the static memory 1006, and the processor 1002 may be considered machine-readable media (e.g., tangible and non-transitory machine-readable media). The instructions 1024 may be transmitted or received over the network 190 via the network interface device 1020. For example, the network interface device 1020 may communicate the instructions 1024 using any one or more transfer protocols (e.g., hypertext transfer protocol (HTTP)).

In some examples, the example machine 1000 of FIG. 10 may be a portable computing device (e.g., a smart phone, a tablet computer, or a wearable device), and may have one or more additional example input components 1030 (e.g., sensors or gauges). Examples of such input components 1030 include an image input component (e.g., one or more cameras), an audio input component (e.g., one or more microphones), a direction input component (e.g., a compass), a location input component (e.g., a global positioning system (GPS) receiver), an orientation component (e.g., a gyroscope), a motion detection component (e.g., one or more accelerometers), an altitude detection component (e.g., an altimeter), a biometric input component (e.g., a heartrate detector or a blood pressure detector), and a gas detection component (e.g., a gas sensor). Input data gathered by any one or more of these input components may be accessible and available for use by any of the modules described herein.

As used herein, the term "memory" refers to a machine-readable medium able to store data temporarily or permanently and may be taken to include, but not be limited to, random-access memory (RAM), read-only memory (ROM), buffer memory, flash memory, and cache memory. While the example machine-readable medium 1022 of FIG. 10 is shown in an example embodiment to be a single medium, the term "machine-readable medium" should be taken to include a single medium or multiple media (e.g., a centralized or distributed database, or associated caches and servers) able to store instructions. The term "machine-readable medium" shall also be taken to include any medium, or combination of multiple media, that is capable of storing the instructions 1024 for execution by the example machine 1000, such that the instructions 1024, when executed by one or more processors of the machine 1000 (e.g., processor 1002), cause the machine 1000 to perform any one or more of the methodologies described herein, in whole or in part. In some examples, the instructions 1024 for execution by the machine 1000 may be communicated by a carrier medium. Examples of such a carrier medium include a storage medium (e.g., a non-transitory machine-readable storage medium, such as a solid-state memory, being physically moved from one place to another place) and a transient medium (e.g., a propagating signal that communicates the instructions 1024).

Certain examples are described herein as including modules. Modules may constitute software modules (e.g., code stored or otherwise embodied in a machine-readable medium or in a transmission medium), hardware modules, or any suitable combination thereof. A "hardware module" is a tangible (e.g., non-transitory) physical component (e.g., a set of one or more processors) capable of performing certain operations and may be configured or arranged in a certain physical manner. In various examples, one or more computer systems or one or more hardware modules thereof may be configured by software (e.g., an application or portion thereof) as a hardware module that operates to perform operations described herein for that module.

In some examples, a hardware module may be implemented mechanically, electronically, hydraulically, or any suitable combination thereof. For example, a hardware module may include dedicated circuitry or logic that is permanently configured to pertain certain operations. A hardware module may be or include a special-purpose processor, such as a field programmable gate array (FPGA) or an ASIC. A hardware module may also include programmable logic or circuitry that is temporarily configured by software to perform certain operations. As an example, a hardware module may include software encompassed within a CPU or other programmable processor. It will be appreciated that the decision to implement a hardware module mechanically, hydraulically, in dedicated and permanently configured circuitry, or in temporarily configured circuitry (e.g., configured by software) may be driven by cost and time considerations.

Accordingly, the phrase "hardware module" should be understood to encompass a tangible entity that may be physically constructed, permanently configured (e.g., hardwired), or temporarily configured (e.g., programmed) to operate in a certain manner or to perform certain operations described herein. Furthermore, as used herein, the phrase "hardware-implemented module" refers to a hardware module. Considering examples in which hardware modules are temporarily configured (e.g., programmed), each of the hardware modules need not be configured or instantiated at any one instance in time. For example, where a hardware module includes a CPU configured by software to become a special-purpose processor, the CPU may be configured as respectively different special-purpose processors (e.g., each included in a different hardware module) at different times. Software (e.g., a software module) may accordingly configure one or more processors, for example, to become or otherwise constitute a particular hardware module at one instance of time and to become or otherwise constitute a different hardware module at a different instance of time.

Hardware modules can provide information to, and receive information from, other hardware modules. Accordingly, the described hardware modules may be regarded as being communicatively coupled. Where multiple hardware modules exist contemporaneously, communications may be achieved through signal transmission (e.g., over circuits and buses) between or among two or more of the hardware modules. In embodiments in which multiple hardware modules are configured or instantiated at different times, communications between such hardware modules may be achieved, for example, through the storage and retrieval of information in memory structures to which the multiple hardware modules have access. For example, one hardware module may perform an operation and store the output of that operation in a memory (e.g., a memory device) to which it is communicatively coupled. A further hardware module may then, at a later time, access the memory to retrieve and process the stored output. Hardware modules may also initiate communications with input or output devices, and can operate on a resource (e.g., a collection of information from a computing resource).

The various operations of example methods described herein may be performed, at least partially, by one or more processors that are temporarily configured (e.g., by software) or permanently configured to perform the relevant operations. Whether temporarily or permanently configured, such processors may constitute processor-implemented modules that operate to perform one or more operations or functions described herein. As used herein, "processor-implemented module" refers to a hardware module in which the hardware includes one or more processors. Accordingly, the operations described herein may be at least partially processor-implemented, hardware-implemented, or both, since a processor is an example of hardware, and at least some operations within any one or more of the methods discussed herein may be performed by one or more processor-implemented modules, hardware-implemented modules, or any suitable combination thereof.

Moreover, such one or more processors may perform operations in a "cloud computing" environment or as a service (e.g., within a "software as a service" (SaaS) implementation). For example, at least some operations within any one or more of the methods discussed herein may be performed by a group of computers (e.g., as examples of machines that include processors), with these operations being accessible via a network (e.g., the Internet) and via one or more appropriate interfaces (e.g., an application program interface (API)). The performance of certain operations may be distributed among the one or more processors, whether residing only within a single machine or deployed across a number of machines. In some examples, the one or more processors or hardware modules (e.g., processor-implemented modules) may be located in a single geographic location (e.g., within a home environment, an office environment, or a server farm). In other examples, the one or more processors or hardware modules may be distributed across a number of geographic locations.

Throughout this specification, plural instances may implement components, operations, or structures described as a single instance. Although individual operations of one or more methods are illustrated and described as separate operations, one or more of the individual operations may be performed concurrently, and nothing requires that the operations be performed in the order illustrated. Structures and their functionality presented as separate components and functions in example configurations may be implemented as a combined structure or component with combined functions. Similarly, structures and functionality presented as a single component may be implemented as separate components and functions. These and other variations, modifications, additions, and improvements fall within the scope of the subject matter herein.

Some portions of the subject matter discussed herein may be presented in terms of algorithms or symbolic representations of operations on data stored as bits or binary digital signals within a memory (e.g., a computer memory or other machine memory). Such algorithms or symbolic representations are examples of techniques used by those of ordinary skill in the data processing arts to convey the substance of their work to others skilled in the art. As used herein, an "algorithm" is a self-consistent sequence of operations or similar processing leading to a desired result. In this context, algorithms and operations involve physical manipulation of physical quantities. Typically, but not necessarily, such quantities may take the form of electrical, magnetic, or optical signals capable of being stored, accessed, transferred, combined, compared, or otherwise manipulated by a machine. It is convenient at times, principally for reasons of common usage, to refer to such signals using words such as "data," "content," "bits," "values," "elements," "symbols," "characters," "terms," "numbers," "numerals," or the like. These words, however, are merely convenient labels and are to be associated with appropriate physical quantities.

Unless specifically stated otherwise, discussions herein using words such as "accessing," "processing," "detecting," "computing," "calculating," "determining," "generating," "presenting," "displaying," or the like refer to actions or processes performable by a machine (e.g., a computer) that manipulates or transforms data represented as physical (e.g., electronic, magnetic, or optical) quantities within one or more memories (e.g., volatile memory, non-volatile memory, or any suitable combination thereof), registers, or other machine components that receive, store, transmit, or display information. Furthermore, unless specifically stated otherwise, the terms "a" or "an" are herein used, as is common in patent documents, to include one or more than one instance. Finally, as used herein, the conjunction "or" refers to a non-exclusive "or," unless specifically stated otherwise.

The following enumerated embodiments describe various examples of methods, machine-readable media, and systems (e.g., machines, devices, or other apparatus) discussed herein.

A first example is a method comprising:

generating, by executing one or more instructions on a processor, a set of transition matrices based on a plurality of time frames of the audio data, each of the plurality of transition matrices generated based on a different pair of time frames in the plurality of time frames, and indicating probabilities that anterior musical notes in an anterior time frame of the pair transition to posterior musical notes in a posterior time frame of the pair;

generating, by executing one or more instructions on a processor, a data structure representing how the audio data changes statistically between the plurality of time frames based on the set of transition matrices; and causing, by executing one or more instructions on a processor, a database to store the data structure within metadata that describes the audio data.

A second example is the example method of example 1, wherein the data structure includes a transchromagram.

A third example is the example method of the second example, further including accessing, by executing one or more instructions on a processor, a chromagram of audio data, the chromagram indicating energy values that occur in corresponding time frames of the audio data at corresponding frequency ranges that partition a set of musical octaves into musical notes that are each represented by a different frequency range among the frequency ranges, the transchromagram a transchromagram of the chromagram.

A fourth example is the example method of the second example, wherein the generating of the transchromagram includes generating a mean transition matrix by averaging the generated set of transition matrices, the generated transchromagram including the generated mean transition matrix.

A fifth example is the method of any of the first example to the fourth example, wherein the generating of the set of transition matrices includes generating a two-dimensional transition matrix based on a pair of time frames selected from the plurality of time frames of the audio data.

A sixth example is the method of the fifth example, wherein the pair of time frames is a sequential pair of adjacent time frames within the audio data, and the generated two-dimensional transition matrix indicates (e.g., by inclusion) a probability of a first musical note transitioning to a second musical note during the sequential pair of adjacent time frames.

A seventh example is any of the method of the first example to the sixth example, wherein the generating of the set of transition matrices includes generating a three-dimensional transition matrix based on a trio of time frames selected from the plurality of time frames of the audio data.

A eight example is the method of the seventh embodiment, wherein the trio of time frames is a sequential trio of consecutive time frames within the audio data, and the generated three-dimensional transition matrix indicates (e.g., by inclusion) a probability of a first musical note transitioning to a second musical note and then transitioning to a third musical note during the sequential trio of consecutive time frames.

A ninth example is the method of any of the first example to the eighth example, wherein the generating of the set of transition matrices includes generating a four-dimensional transition matrix based on a quartet of time frames selected from the plurality of time frames of the audio data.

An tenth example is the method of the ninth example, wherein the quartet of time frames is a sequential quartet of consecutive time frames within the audio data, and the generated four-dimensional transition matrix indicates (e.g., by inclusion) a probability of a first musical note transitioning to a second musical note, then transitioning to a third musical note, and then transitioning to a fourth musical note during the sequential quartet of consecutive time frames.

A eleventh example is the method of any of the first through the tenth examples, further comprising normalizing the energy values of the accessed chromagram, the normalized energy values ranging between zero and unity; and wherein the generating of the set of transition matrices is based on the normalized energy values that range between zero and unity.

A twelfth example is the method of any of the first through the eleventh examples, wherein the audio data is reference audio data identified by a reference identifier stored in the metadata that describes the reference audio data, the transchromagram is a reference transchromagram correlated by the database with the reference audio data, and the method further comprises causing a support vector machine to be trained via machine-learning to recognize the reference audio data based on the reference transchromagram, receiving query audio data to be identified, generating a query transchromagram based on the query audio data, and causing a device to present a notification that the query audio data is identified by the reference identifier based on a comparison of the query transchromagram to the reference transchromagram.

An thirteenth example is the method of any of the first through the twelfth examples, wherein the audio data is reference audio data in a reference musical key indicated by the metadata that describes the reference audio data, the transchromagram is a reference transchromagram correlated by the database with the reference audio data, and the method further comprises causing a support vector machine to be trained via machine-learning to detect the reference musical key based on the reference transchromagram, receiving query audio data to be analyzed, generating a query transchromagram based on the query audio data, and causing a device to present a notification that the query audio data is in the reference musical key based on a comparison of the query transchromagram to the reference transchromagram.

A fourteenth example is the method of any of the first through the thirteenth examples, wherein the audio data is reference audio data that contains a reference musical chord indicated by the metadata that describes the reference audio data, the transchromagram is a reference transchromagram correlated by the database with the reference musical chord, and the method further comprises causing a support vector machine to be trained via machine-learning to detect the reference musical chord based on the reference transchromagram, receiving query audio data to be analyzed, generating a query transchromagram based on the query audio data, and causing a device to present a notification that the query audio data contains the reference musical chord based on a comparison of the query transchromagram to the reference transchromagram.

A fifteenth example is the method of the fourteenth example, wherein the reference musical chord is an arpeggiated musical chord that includes multiple musical notes played one musical note at a time over multiple sequential time frames of the reference audio data.

A sixteenth example is the method of any of the first through the fifteenth examples, wherein the audio data is reference audio data that has a reference song structure of multiple sequential song segments, the reference song structure being indicated by the metadata that describes the reference audio data, the transchromagram is a reference transchromagram correlated by the database with the reference song structure, and the method further comprises causing a support vector machine to be trained via machine-learning to detect the reference song structure based on the reference transchromagram, receiving query audio data to be analyzed, generating a query transchromagram based on the query audio data, and causing a device to present a notification that the query audio data has the reference song structure based on a comparison of the query transchromagram to the reference transchromagram.

A seventeenth example is the method of any of the first through the sixteenth examples, wherein the audio data is reference audio data that exemplifies a reference musical genre indicated by the metadata that describes the reference audio data, the transchromagram is a reference transchromagram correlated by the database with the reference musical genre, and the method further comprises, causing a support vector machine to be trained via machine-learning to detect the reference musical genre based on the reference transchromagram, receiving query audio data to be analyzed, generating a query transchromagram based on the query audio data, and causing a device to present a notification that the query audio data exemplifies the reference musical genre based on a comparison of the query transchromagram to the reference transchromagram.

A eighteenth example is the method of any of the first through the seventeenth examples, further comprising calculating a constant Q transform of the audio data, and creating the chromagram of the audio data based on the constant Q transform of the audio data.

A nineteenth example is a machine-readable medium (e.g., a non-transitory machine-readable storage medium) comprising instructions that, when executed by one or more processors of a machine, cause the machine to perform operations comprising accessing a chromagram of audio data, the chromagram indicating energy values that occur in corresponding time frames of the audio data at corresponding frequency ranges that partition a set of musical octaves into musical notes that are each represented by a different frequency range among the frequency ranges, generating a set of transition matrices based on a plurality of the time frames of the audio data, each transition matrix in the set being generated based on a different pair of time frames in the plurality and indicating probabilities that anterior musical notes in an anterior time frame of the pair transition to posterior musical notes in a posterior time frame of the pair, generating a transchromagram of the chromagram based on the set of transition matrices generated based on the plurality of the time frames of the audio data, and causing a database to store the transchromagram of the chromagram within metadata that describes the audio data.

An twentieth examples is the example machine-readable medium of the nineteenth example, wherein the operations further comprise calculating a constant Q transform of the audio data, and generating the chromagram of the audio data based on the constant Q transform of the audio data, and wherein the generating of the chromagram includes representing fundamental frequencies of the audio data and overtone frequencies of the audio data within two musical octaves, and the frequency ranges of the chromagram partition the two musical octaves into twenty-four equal-tempered semitone notes.

A twenty-first example is a system comprising one or more processors, and a memory storing instructions that, when executed by at least one processor among the one or more processors, cause the system to perform operations comprising accessing a chromagram of audio data, the chromagram indicating energy values that occur in corresponding time frames of the audio data at corresponding frequency ranges that partition a set of musical octaves into musical notes that are each represented by a different frequency range among the frequency ranges, generating a set of transition matrices based on a plurality of the time frames of the audio data, each transition matrix in the set being generated based on a different pair of time frames in the plurality and indicating probabilities that anterior musical notes in an anterior time frame of the pair transition to posterior musical notes in a posterior time frame of the pair, generating a transchromagram of the chromagram based on the set of transition matrices generated based on the plurality of the time frames of the audio data, and causing a database to store the transchromagram of the chromagram within metadata that describes the audio data.

A twenty-second example is the system of the twenty-first example, wherein the operations further comprise, calculating a constant Q transform of the audio data and generating the chromagram of the audio data based on the constant Q transform of the audio data, and wherein the generating of the chromagram includes representing fundamental frequencies of the audio data and overtone frequencies of the audio data within one musical octave, and the frequency ranges of the chromagram partition the one musical octave into twelve equal-tempered semitone notes.

A twenty-third example is an apparatus including a chromagram accessor to access a chromagram of audio data, the chromagram indicating energy values that occur in corresponding time frames of the audio data at corresponding frequency ranges that partition a set of musical octaves into musical notes that are each represented by a different frequency range among the frequency ranges;

a transchromagram generator to:

generate a set of transition matrices based on a plurality of the time frames of the audio data, each transition matrix in the set being generated based on a different pair of time frames in the plurality and indicating probabilities that anterior musical notes in an anterior time frame of the pair transition to posterior musical notes in a posterior time frame of the pair; and generate a transchromagram of the chromagram based on the set of transition matrices generated based on the plurality of the time frames of the audio data; and a database controller to store the transchromagram of the chromagram within metadata that describes the audio data.

A twenty-fourth example is the apparatus of the twenty-third example, wherein the transchromagram generator generates the transchromagram by generating a mean transition matrix by averaging the generated set of transition matrices, the generated transchromagram including the generated mean transition matrix.

A twenty-fifth example is the apparatus of the twenty-third example, wherein the transchromagram generator generates the set of transition matrices by generating a transition matrix based on one or more time frames selected from the plurality of time frames of the audio data.

A twenty-sixth embodiment includes a non-transitory computer-readable storage medium carrying machine-readable instructions for controlling a machine to carry out any of the previously described examples.

What is claimed is:

1. An apparatus comprising:

a transchromagram generator to generate a data structure based on a set of transition matrices corresponding to a plurality of time frames of audio data, the data structure indicative of probabilities that first musical notes will transition to second musical notes:

a database controller to prompt a database to store the data structure within the audio data; and a notification manager to generate, based on a comparison between query audio data and the stored data structure of the audio data, a notification identifying at least one characteristic of the query audio data.

2. The apparatus as defined in claim 1, wherein the data structure includes a transchromagram, wherein the transchromagram represents attributes of the audio data.

3. The apparatus as defined in claim 2, further including a chromagram accessor to access a chromagram of audio data, the chromagram indicating energy values that occur in corresponding time frames of the audio data at corresponding frequency ranges that partition a set of musical octaves into musical notes that are each represented by a different frequency range among the frequency ranges, wherein the transchromagram is a transchromagram of the chromagram.

4. The apparatus as defined in claim 1, wherein generating of a transchromagram, the transchromagram included in the data structure, includes generating a mean transition matrix by averaging the generated set of transition matrices.

5. The apparatus as defined in claim 1, wherein generating of the set of transition matrices includes generating a two-dimensional transition matrix based on a pair of time frames selected from the plurality of time frames of the audio data.

6. The apparatus as defined in claim 5, wherein:

the pair of time frames is a sequential pair of adjacent time frames within the audio data; and the generated two-dimensional transition matrix indicates a probability of a first musical note transitioning to a second musical note during the sequential pair of adjacent time frames.

7. The apparatus as defined in claim 1, wherein the notification identifies at least one of the query audio data, a musical key of the query audio data, a musical chord of the query audio data, a song structure of the query audio data, or a musical genre of the query audio data.

8. A non-transitory computer readable storage medium comprising instructions that, when executed, cause a machine to, at least:

generate a data structure based on a set of transition matrices corresponding to a plurality of time frames of audio data, the data structure indicative of probabilities that first musical notes will transition to second musical notes;

prompt a database to store the data structure within the audio data; and generate, based on a comparison between query audio data and the stored data structure of the audio data, a notification identifying at least one characteristic of the query audio data.

9. The non-transitory computer readable storage medium as defined in claim 8, wherein the data structure includes a transchromagram.

10. The non-transitory computer readable storage medium as defined in claim 9, further including instructions that, when executed, cause the machine to:

access a chromagram of audio data, the chromagram indicating energy values that occur in corresponding time frames of the audio data at corresponding frequency ranges that partition a set of musical octaves into musical notes that are each represented by a different frequency range among the frequency ranges, the transchromagram a transchromagram of the chromagram.

11. The non-transitory computer readable storage medium as defined in claim 9, wherein generating of the transchromagram includes generating a mean transition matrix by averaging the generated set of transition matrices.

12. The non-transitory computer readable storage medium as defined in claim 9, wherein generating of the set of transition matrices includes generating a two-dimensional transition matrix based on a pair of time frames selected from the plurality of time frames of the audio data.

13. The non-transitory computer readable storage medium as defined in claim 12, wherein:

the pair of time frames is a sequential pair of adjacent time frames within the audio data; and the generated two-dimensional transition matrix indicates a probability of a first musical note transitioning to a second musical note during the sequential pair of adjacent time frames.

14. The non-transitory computer readable storage medium as defined in claim 8, wherein the notification identifies at least one of the query audio data, a musical key of the query audio data, a musical chord of the query audio data, a song structure of the query audio data, or a musical genre of the query audio data.

15. A method comprising:

generating a data structure based on a set of transition matrices corresponding to a plurality of time frames of audio data, the data structure indicative of probabilities that first musical notes will transition to second musical notes:

prompting a database to store the data structure within the audio data; and generating, based on a comparison between query audio data and the stored data structure of the audio data, a notification identifying at least one characteristic of the query audio data.

16. The method as defined in claim 15, wherein the data structure includes a transchromagram.

17. The method as defined in claim 16, further including accessing a chromagram of audio data, the chromagram indicating energy values that occur in corresponding time frames of the audio data at corresponding frequency ranges that partition a set of musical octaves into musical notes that are each represented by a different frequency range among the frequency ranges, the transchromagram a transchromagram of the chromagram.

18. The method as defined in claim 16, wherein generating of the transchromagram includes generating a mean transition matrix by averaging the generated set of transition matrices.

19. The method as defined in claim 16, wherein generating of the set of transition matrices includes generating a two-dimensional transition matrix based on a pair of time frames selected from the plurality of time frames of the audio data.

20. The method as defined in claim 15, wherein the notification identifies at least one of the query audio data, a musical key of the query audio data, a musical chord of the query audio data, a song structure of the query audio data, or a musical genre of the query audio data.

* * * * *